US010765917B2

(12) United States Patent
Watanabe et al.

(10) Patent No.: US 10,765,917 B2
(45) Date of Patent: Sep. 8, 2020

(54) MULTI-PIECE SOLID GOLF BALL

(71) Applicant: Bridgestone Sports Co., Ltd., Minato-ku, Tokyo (JP)

(72) Inventors: Hideo Watanabe, Chichibushi (JP); Katsunori Sato, Chichibushi (JP); Masanobu Kuwahara, Chichibushi (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 16/194,871

(22) Filed: Nov. 19, 2018

(65) Prior Publication Data

US 2019/0217161 A1 Jul. 18, 2019

Related U.S. Application Data

(63) Continuation-in-part of application No. 15/948,267, filed on Apr. 9, 2018.

(51) Int. Cl.
*A63B 37/04* (2006.01)
*A63B 37/06* (2006.01)
(Continued)

(52) U.S. Cl.
CPC ..... *A63B 37/0076* (2013.01); *A63B 37/004* (2013.01); *A63B 37/0012* (2013.01); *A63B 37/0018* (2013.01); *A63B 37/0019* (2013.01); *A63B 37/0021* (2013.01); *A63B 37/0022* (2013.01); *A63B 37/0031* (2013.01); *A63B 37/0032* (2013.01); *A63B 37/0043* (2013.01); *A63B 37/0044* (2013.01); *A63B 37/0063* (2013.01); *A63B 37/0064* (2013.01);
(Continued)

(58) Field of Classification Search
USPC ..... 473/351–385
See application file for complete search history.

(56) References Cited

U.S. PATENT DOCUMENTS 5,424,990 A 6/1995 Ohsawa
5,782,707 A 7/1998 Yamagishi et al.
(Continued)

FOREIGN PATENT DOCUMENTS

JP 09239068 A 9/1997
JP 11104273 A 4/1999
(Continued)

*Primary Examiner* — Alvin A Hunter
(74) *Attorney, Agent, or Firm* — Sughrue Mion, PLLC

(57) ABSTRACT

In a multi-piece solid golf ball having a core, an intermediate layer encasing the core and a cover which encases the intermediate layer and has numerous dimples on an outside surface thereof, the intermediate layer is formed of a resin material, the cover is formed of a urethane resin material, the core has a diameter of at least 38.0 mm, the sphere obtained by encasing the core with the intermediate layer has a surface hardness on the Shore D hardness scale of at least 69, the cover has a material hardness on the Shore D hardness scale of 55 or less, the (intermediate layer thickness)/(core diameter) value is from 0.025 to 0.043, the (cover thickness)/(core diameter) value is from 0.014 to 0.027, and the sphere obtained by encasing the core with the intermediate layer has an initial velocity A and the core has an initial velocity B which together satisfy the condition A−B≥0 m/s.

19 Claims, 4 Drawing Sheets

(51) Int. Cl.
*A63B 37/00* (2006.01)
*A63B 102/32* (2015.01)

(52) U.S. Cl.
CPC ..... *A63B 37/0065* (2013.01); *A63B 37/0068* (2013.01); *A63B 37/0075* (2013.01); *A63B 37/0077* (2013.01); *A63B 37/0084* (2013.01); *A63B 37/0092* (2013.01); *A63B 37/0033* (2013.01); *A63B 37/0045* (2013.01); *A63B 37/0096* (2013.01); *A63B 2102/32* (2015.10)

(56) References Cited

U.S. PATENT DOCUMENTS 6,267,694 B1 7/2001 Higuchi et al.
6,533,683 B2 3/2003 Watanabe
6,558,275 B2 * 5/2003 Ohama ..... A63B 37/0003 473/351
6,592,470 B2 7/2003 Watanabe et al.
6,656,059 B2 12/2003 Umezawa et al.
6,659,889 B2 * 12/2003 Kasashima ..... A63B 37/0004 473/373
6,702,695 B1 3/2004 Higuchi et al.
6,790,148 B1 * 9/2004 Yoshida ..... A63B 37/0003 473/374
6,929,568 B2 * 8/2005 Nesbitt ..... A63B 37/0003 473/376
6,981,925 B2 1/2006 Shimizu et al.
7,056,232 B2 6/2006 Maruko et al.
7,056,234 B2 * 6/2006 Kasashima ..... A63B 37/0004 473/384
7,101,292 B2 * 9/2006 Ohama ..... A63B 37/0003 473/374
7,118,494 B2 10/2006 Higuchi et al.
7,278,929 B2 * 10/2007 Umezawa ..... A63B 37/0031 473/373
7,300,362 B1 11/2007 Umezawa et al.
7,329,194 B2 * 2/2008 Watanabe ..... A63B 37/0003 473/376
7,344,454 B2 3/2008 Umezawa et al.
7,513,837 B2 4/2009 Umezawa et al.
7,850,548 B2 * 12/2010 Watanabe ..... A63B 37/0076 473/376
7,909,710 B2 * 3/2011 Higuchi ..... A63B 37/0003 473/373
7,946,933 B2 5/2011 Nanba et al.
7,959,524 B2 6/2011 Nanba et al.
8,393,978 B2 3/2013 Watanabe et al.
8,545,346 B2 * 10/2013 Higuchi ..... A63B 37/0087 473/373
8,657,704 B2 * 2/2014 Ohama ..... A63B 37/0003 473/371
8,672,775 B2 * 3/2014 Higuchi ..... A63B 37/0003 473/373
8,672,776 B2 * 3/2014 Higuchi ..... A63B 37/0003 473/373
8,951,148 B2 * 2/2015 Matsuyama ..... C08G 18/4854 473/376
9,061,183 B2 * 6/2015 Isogawa ..... A63B 37/0003
9,199,130 B2 * 12/2015 Fushihara ..... A63B 37/0063
9,636,547 B2 5/2017 Watanabe et al.
9,873,024 B2 1/2018 Kimura et al.
2011/0250989 A1 10/2011 Umezawa et al.

FOREIGN PATENT DOCUMENTS

JP 2001054588 A 2/2001
JP 2001299961 A 10/2001
JP 2002011117 A 1/2002
JP 2002315848 A 10/2002
JP 2002345999 A 12/2002
JP 2004180822 A 7/2004
JP 2005224514 A 8/2005
JP 2005224515 A 8/2005
JP 2006204908 A 8/2006
JP 2006312044 A 11/2006
JP 2008119461 A 5/2008
JP 2009034505 A 2/2009
JP 2009106739 A 5/2009
JP 2010179119 A 8/2010
JP 2010188199 A 9/2010
JP 2011120898 A 6/2011
JP 2011218161 A 11/2011
JP 2013230362 A 11/2013
JP 2016112308 A 6/2016

* cited by examiner

MULTI-PIECE SOLID GOLF BALL

CROSS-REFERENCE TO RELATED APPLICATION

This application is a continuation-in-part of copending application Ser. No. 15/948,267 filed on Apr. 9, 2018, the entire contents of which are hereby incorporated by reference.

TECHNICAL FIELD

This invention relates to a multi-piece solid golf ball having at least a three-layer construction that includes a core, an intermediate layer and a cover. More specifically, the invention relates to a multi-piece solid golf ball which holds down the spin rate on full shots, providing an excellent flight performance, and which has a soft feel at impact and a good durability to repeated impact.

BACKGROUND ART

Key performance features required in a golf ball include distance, controllability, durability and feel at impact. Balls endowed with these qualities in the highest degree are constantly being sought. Among recent golf balls, there has emerged a succession of balls which have multilayer structures typically consisting of three pieces (or layers). By having the structure of a golf ball be multilayered, it is possible to combine many materials of different properties, enabling a wide variety of ball designs in which each layer has a particular function to be obtained.

Of these, functional multi-piece solid golf balls having an optimized hardness relationship among the layers encasing the core, such as an intermediate layer and a cover (outermost layer), are widely used. For example, golf balls which have three or more layers, including at least a core, an intermediate layer and a cover, and which are focused on design attributes such as the core diameter, the intermediate layer and cover thicknesses, the deflection of the core under specific loading and the hardnesses of the respective layers, are disclosed in the following patent publications: JP-A 2002-11117, JP-A H9-239068, JP-A H11-104273, JP-A 2001-54588, JP-A 2001-299961, JP-A 2010-188199, JP-A 2010-179119, JP-A 2002-315848, JP-A 2002-345999, JP-A 2004-180822, JP-A 2005-224514, JP-A 2005-224515, JP-A 2006-204908, JP-A 2006-312044, JP-A 2008-119461, JP-A 2009-106739, JP-A 2009-34505, JP-A 2011-120898, JP-A 2011-218161, JP-A 2013-230362 and JP-A 2016-112308.

However, none of the above multi-piece solid golf balls are entirely satisfactory in terms of being able to provide an increased distance by holding down the spin rate on full shots, and moreover achieving both a soft feel and a good durability to repeated impact. In particular, given that, in addition to professional golfers, the golf ball market also includes many mid-level amateur golfers whose head speeds are not as fast as those of professionals and skilled amateurs, there has existed a desire for the development of golf balls which, by being endowed with various high-level performance attributes, including not only a good flight performance on shots with a driver (W#1), but also the ability to exhibit a sufficiently high spin performance on approach shots and a good feel at impact, can satisfy mid-level amateur golfers and are enjoyable to use.

SUMMARY OF THE INVENTION

It is therefore an object of the present invention to provide a multi-piece solid golf ball which holds down the spin rate on full shots and imparts an excellent flight performance, and which moreover has a soft feel and a good durability to repeated impact.

As a result of intensive investigations, the inventors have discovered that, in a multi-piece solid golf ball having a core, an intermediate layer and a cover and having numerous dimples formed on an outside surface of the cover, by forming the intermediate layer of a resin material and forming the cover of a urethane resin material, by setting the diameter of the core in a specific range, by setting the surface hardness of the sphere encased by the intermediate layer and the material hardness of the cover in specific respective ranges, by setting the (intermediate layer thickness)/(core diameter) value and the (cover thickness)/(core diameter) value in specific respective ranges, and by specifying the relationship between the initial velocity of the sphere obtained by encasing the core with the intermediate layer and the initial velocity of the core, there can be obtained a golf ball which holds down the spin rate on full shots and which can also have both a soft feel at impact and good durability to repeated impact, and thus is ideal particularly for mid-level amateur golfers having a mid-range head speed.

That is, the multi-piece solid golf ball of the invention has a structure with a somewhat hard intermediate layer and a somewhat soft urethane cover that makes it possible to obtain a lower spin rate on full shots, enabling both a good distance on shots with a driver (W#1) and good ball controllability in the short game to be achieved. Also, the (intermediate layer thickness)/(core diameter) value is optimized in order to achieve both a soft feel at impact and a high durability to repeated impact. In addition, the (cover thickness)/(core diameter) value is optimized in order to achieve both an excellent distance and a high productivity.

Accordingly, the invention provides a multi-piece solid golf ball having a core, an intermediate layer encasing the core and a cover which encases the intermediate layer and has numerous dimples formed on an outside surface (bass surface) thereof, wherein the intermediate layer is formed of a resin material, the cover is formed of a urethane resin material, the core has a diameter of at least 38.0 mm, the sphere obtained by encasing the core with the intermediate layer (intermediate layer-encased sphere) has a surface hardness on the Shore D hardness scale of at least 69, the cover has a material hardness on the Shore D hardness scale of 55 or less, the (intermediate layer thickness)/(core diameter) value is from 0.025 to 0.043, the (cover thickness)/(core diameter) value is from 0.014 to 0.027, and the intermediate layer-encased sphere has an initial velocity A and the core has an initial velocity B which together satisfy the condition $A-B \geq 0$ m/s.

In a preferred embodiment of the golf ball of the invention, the core has a center and a surface such that the value obtained by subtracting the JIS-C hardness at the core center from the JIS-C hardness at the core surface is at least 15.

In another preferred embodiment, the core has a hardness profile from a center to a surface thereof which satisfies the following condition:

(JIS-C hardness at core surface−JIS-C hardness 5 mm inside of core surface)−(JIS-C hardness 5 mm outside of core center−JIS-C hardness at core center)≥0.

In yet another preferred embodiment, the (intermediate layer thickness)/(core diameter) value is from 0.028 to 0.041 and the (cover thickness)/(core diameter) value is from 0.017 to 0.024.

In still another preferred embodiment, the value obtained by subtracting the Shore D hardness at a surface of the core from the Shore D hardness at a surface of the intermediate layer-encased sphere is at least 6, the value obtained by subtracting the Shore D hardness at the surface of the intermediate layer-encased sphere from the Shore D hardness at the ball surface is 0 or less, and the value obtained by subtracting the Shore D hardness at the ball surface from the Shore D hardness at the core surface is −5 or more.

In a further preferred embodiment, the initial velocities of the core, the intermediate layer-encased sphere and the ball satisfy the following relationship:

initial velocity of intermediate layer-encased sphere initial velocity of core>initial velocity of ball.

In a still further preferred embodiment, the dimples formed on the ball surface are of at least three types of differing diameter and/or depth, the total number of dimples is from 250 to 380, and the dimple surface coverage SR, defined as the proportion of the ball surface accounted for by the total surface area of the hypothetical spherical surfaces circumscribed by the edges of the individual dimples, is at least 70%.

In yet another preferred embodiment, the ball has arranged thereon at least one dimple having the cross-sectional shape specified by steps (i) to (iv) below (dimple having a specific cross-sectional shape):

(i) letting the foot of a perpendicular drawn from a deepest point of the dimple to an imaginary plane defined by a peripheral edge of the dimple be the dimple center and a straight line that passes through the dimple center and any one dimple edge be the reference line;

(ii) dividing a segment of the reference line from the dimple edge to the dimple center into at least 100 points and computing the distance ratio for each point when the distance from the dimple edge to the dimple center is set to 100%;

(iii) computing the dimple depth ratio at every 20% from 0 to 100% of the distance from the dimple edge to the dimple center; and (iv) at the depth ratios in dimple regions 20 to 100% of the distance from the dimple edge to the dimple center, determining the change in depth ΔH every 20% of the distance and designing a dimple cross-sectional shape such that the change ΔH is at least 6% and not more than 24% in all regions corresponding to from 20 to 100% of the distance.

In another additional preferred embodiment, the core has a deflection when compressed under a final load of 1,275 N (130 kgf) from an initial load of 98 N (10 kgf) of at least 3.9 mm.

In yet another additional preferred embodiment, the surface of the cover has a coating layer formed thereon and the relationship between the material hardness Hc of the coating layer and the hardness 5 mm inside of the core surface (Cs−5) satisfies the following condition:

$$[(Cs-5)-Hc]\geq 0.$$

ADVANTAGEOUS EFFECTS OF THE INVENTION

With the inventive golf ball, a lower spin rate is obtained on full shots with a driver (W#1), enabling mid-level amateur golfers in particular to achieve a satisfactory increase in distance. The ball also exhibits both a soft feel at impact and excellent durability to repeated impact. Moreover, a high spin rate can be obtained on approach shots, providing excellent controllability in the short game, in addition to which the golf ball also has a high productivity.

BRIEF DESCRIPTION OF THE DIAGRAMS

DESCRIPTION OF THE PREFERRED EMBODIMENTS

The invention is described more fully below.

Figure 1:
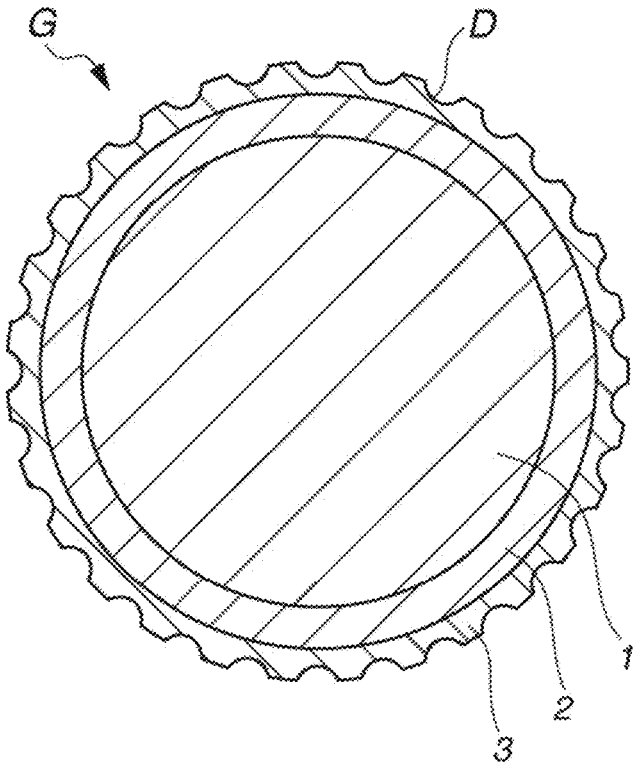
FIG. 1 is a schematic cross-sectional view of a golf ball construction according to one embodiment of the invention.

The multi-piece solid golf ball of the invention has a core, an intermediate layer and a cover. Referring to FIG. 1, which shows an embodiment of the inventive golf ball, the golf ball G has a core 1, an intermediate layer 2 encasing the core 1, and a cover 3 encasing the intermediate layer 2. In this invention, the core may be a single layer or may be formed as a plurality of layers. Numerous dimples D are typically formed on the surface of the cover 3 so as to enhance the aerodynamic properties of the ball. Each layer is described in detail below.

The core may be formed using a known rubber composition. Although not particularly limited, preferred examples include rubber compositions of the formulation shown below.

The core-forming material may be composed primarily of a rubber material. For example, the core may be formed using a rubber composition that includes, together with a base rubber, such ingredients as a co-crosslinking agent, an organic peroxide, an inert filler, sulfur, an antioxidant and an organosulfur compound.

In this invention, it is especially preferable to use a rubber composition that includes compounding ingredients (I) to (III) below:

(I) a base rubber (II) an organic peroxide (III) water and/or a metal monocarboxylate The base rubber serving as ingredient (I) is not particularly limited, although the use of polybutadiene is especially preferred.

It is desirable for the polybutadiene to have a cis-1,4 bond content on the polymer chain of at least 60 wt %, preferably at least 80 wt %, more preferably at least 90 wt %, and most preferably at least 95 wt %. When cis-1,4 bonds account for too few of the bonds on the polybutadiene molecule, the resilience may decrease.

A polybutadiene rubber synthesized with a catalyst differing from the above lanthanum series rare-earth compound may also be included in the base rubber. In addition, styrene-butadiene rubber (SBR), natural rubber, polyisoprene rubber, ethylene-propylene-diene rubber (EPDM) or the like may also be included. These may be used singly or two or more may be used in combination.

The organic peroxide (II), although not particularly limited, is preferably an organic peroxide having a one-minute half-life temperature of between 110 and 185° C. One, two or more organic peroxides may be used. The amount of organic peroxide included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight. A commercial product may be used as the organic peroxide. Specific examples include those available under the trade names Percumyl D, Perhexa C-40, Niper BW and Peroyl L (all products of NOF Corporation), and Luperco 231XL (from AtoChem Co.).

Next, the water serving as component III is not particularly limited, and may be distilled water or tap water. The use of distilled water that is free of impurities is especially preferred. The amount of water included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight.

By including a suitable amount of such water, the moisture content of the rubber composition before vulcanization becomes preferably at least 1,000 ppm, and more preferably at least 1,500 ppm. The upper limit is preferably not more than 8,500 ppm, and more preferably not more than 8,000 ppm. When the moisture content of the rubber composition is too low, it may be difficult to obtain a suitable crosslink density and tan δ, which may make it difficult to mold a golf ball that minimizes energy loss and has a reduced spin rate. On the other hand, when the moisture content of the rubber composition is too high, the core may be too soft, which may make it difficult to obtain a suitable core initial velocity.

Although it is also possible to add water directly to the rubber composition, the following methods (i) to (iii) may be employed to incorporate water:

(i) applying water in the form of a mist (i.e., as steam or by means of ultrasound) to some or all of the rubber composition (compounded material);
(ii) immersing some or all of the rubber composition in water;
(iii) letting some or all of the rubber composition stand for a given period of time in a high-humidity environment in a place where the humidity can be controlled, such as a constant humidity chamber.

The "high-humidity environment" is not particularly limited, so long as it is an environment capable of moistening the rubber composition, although a humidity of from 40 to 100% is preferred.

Alternatively, the water may be worked into a jelly state and added to the above rubber composition. Or a material obtained by first supporting water on a filler, unvulcanized rubber, rubber powder or the like may be added to the rubber composition. In such a form, the workability is better than when water is directly added to the composition, enabling the efficiency of golf ball production to be increased. The type of material in which a given amount of water has been included, although not particularly limited, is exemplified by fillers, unvulcanized rubbers and rubber powders in which sufficient water has been included. The use of a material which incurs no loss of durability or resilience is especially preferred. The moisture content of the above material is preferably at least 5 wt %, and more preferably at least 10 wt %. The upper limit is preferably not more than 99 wt %, and even more preferably not more than 95 wt %.

Alternatively, a metal monocarboxylate may be used instead of the above-described water. Metal monocarboxylates, in which the carboxylic acid is presumably coordination-bonded to the metal, are distinct from metal dicarboxylates such as zinc diacrylate of the formula $(CH_2{=}CHCOO)_2Zn$. A metal monocarboxylate introduces water into the rubber composition by way of a dehydration/condensation reaction, and thus provides an effect similar to that of water. Moreover, because a metal monocarboxylate can be added to the rubber composition as a powder, the operations can be simplified and uniform dispersion within the rubber composition is easy. In order to carry out the above reaction effectively, a monosalt is required. The amount of metal monocarboxylate included per 100 parts by weight of the base rubber is preferably at least 1 part by weight, and more preferably at least 3 parts by weight. The upper limit in the amount of metal monocarboxylate included is preferably not more than 60 parts by weight, and more preferably not more than 50 parts by weight. When the amount of metal monocarboxylate included is too small, it may be difficult to obtain a suitable crosslink density and tan δ, as a result of which a sufficient golf ball spin rate-lowering effect may not be achievable. On the other hand, when too much is included, the core may become too hard, as a result of which it may be difficult for the ball to retain a suitable feel at impact.

The carboxylic acid used may be, for example, acrylic acid, methacrylic acid, maleic acid, fumaric acid or stearic acid. Examples of the substituting metal include sodium, potassium, lithium, zinc, copper, magnesium, calcium, cobalt, nickel and lead, although the use of zinc is preferred. Illustrative examples of the metal monocarboxylate include zinc monoacrylate and zinc monomethacrylate, with the use of zinc monoacrylate being especially preferred.

The rubber composition containing the various above ingredients is prepared by mixture using a typical mixing apparatus, such as a Banbury mixer or a roll mill. When this rubber composition is used to mold the core, molding may be carried out by compression molding or injection molding using a specific mold for molding cores. The resulting molded body is then heated and cured under temperature conditions sufficient for the organic peroxide or co-crosslinking agent included in the rubber composition to act, thereby giving a core having a specific hardness profile. The vulcanization conditions in this case are not particularly limited, although the conditions are typically set to between about 100° C. and about 200° C., especially between 130° C. and 170° C., and from 10 to 40 minutes, especially from 12 to 20 minutes.

The core diameter, although not particularly limited, is set to preferably at least 38.0 mm, more preferably at least 38.1 mm, and even more preferably at least 38.2 mm. The upper limit is preferably not more than 39.1 mm, more preferably not more than 38.9 mm, and even more preferably not more than 38.7 mm. When the core diameter is smaller than this range, the initial velocity on full shots decreases and a good distance is not obtained. On the other hand, when the core diameter is larger than this range, the combined thickness of the cover and the intermediate layer must be made correspondingly smaller, as a result of which the durability to cracking on repeated impact may worsen.

The core center hardness (Cc) on the JIS-C hardness scale, although not particularly limited, may be set to preferably at least 46, more preferably at least 50, and even more preferably at least 54. There is also no particular upper limit in the JIS-C hardness, although this may be set to preferably not more than 65, more preferably not more than 62, and even more preferably not more than 58. When the core center hardness on the JIS-C hardness scale is too large, the spin rate may rise excessively, resulting in a poor distance, or the feel of the ball at impact may be too hard. On the other hand, when this value is too small, the durability of the ball to cracking on repeated impact may worsen or the feel at impact may be too soft.

The core surface hardness (Cs) is not particularly limited, although this hardness on the JIS-C hardness scale may be set to preferably at least 70, more preferably at least 75, and even more preferably at least 80. There is also no particular upper limit to the JIS-C hardness, although this may be set to preferably not more than 90, more preferably not more than 88, and even more preferably not more than 86. The surface hardness of the core, when expressed on the Shore D hardness scale, is preferably at least 45, more preferably at least 49, and even more preferably at least 53. The upper limit is preferably not more than 60, more preferably not more than 59, and even more preferably not more than 57. When this value is too large, the feel at impact may harden or the durability to cracking on repeated impact may worsen. On the other hand, when this value is too small, the spin rate may rise excessively or the rebound may become low, resulting in a poor distance.

The center hardness (Cc) refers to the hardness measured at the center in a cross-section obtained by cutting the core in half through the center. The surface hardness (Cs) refers to the hardness measured at the spherical surface of the core.

The hardness difference between the core center and surface is optimized so as to increase the hardness difference between the core interior and exterior. That is, the (core surface hardness (Cs)−core center hardness (Cc)) value, expressed on the JIS-C hardness scale, is at least 15, preferably at least 20, and more preferably at least 24. There is no particular upper limit, although the JIS-C hardness is preferably not more than 40, and more preferably not more than 30. When the hardness difference is too small, the spin rate may rise excessively and a good distance may not be achieved. On the other hand, when the hardness difference is too large, the durability to cracking on repeated impact may worsen.

The difference between the core surface hardness (Cs) and the hardness 5 mm inside of the core surface (Cs−5), that is, the value (Cs)−(Cs−5), expressed on the JIS-C hardness scale, may be set to preferably at least 3, more preferably at least 6, and even more preferably at least 9. There is no particular upper limit, although the JIS-C hardness is set to preferably not more than 16, more preferably not more than 14, and even more preferably not more than 12. When this value is too small, the spin rate may rise excessively and a good distance may not be achieved. On the other hand, when this value is too large, the durability to cracking on repeated impact may worsen.

Also, as will be subsequently explained, it is preferable for the relationship between the hardness 5 mm inside of the core surface (Cs−5) and the hardness of a coating layer formed on the cover surface to satisfy a specific condition.

The difference between the hardness 5 mm outside the core center (Cc+5) and the center hardness of the core (Cc), that is, the value (Cc+5)−(Cc), expressed on the JIS-C hardness scale, may be set to preferably at least 0, more preferably at least 1, and even more preferably at least 3. There is no particular upper limit, although the JIS-C hardness may be set to preferably not more than 9, more preferably not more than 7, and even more preferably not more than 5. When this value is too small, the spin rate may rise excessively and a good distance may not be achieved. On the other hand, when this value is too large, the durability to cracking on repeated impact may worsen.

In order for the hardness at and near the surface portion of the core to be higher than the hardness at and near the center portion of the core and to make the hardness gradient near the surface equal to or higher than the hardness gradient near the center, it is preferable to optimize the relationship among the core center hardness (Cc), the hardness 5 mm outside the core center (Cc+5), the hardness 5 mm inside the core surface (Cs−5) and the core surface hardness (Cs) within a specific range. That is, the value {(Cs)−(Cs−5)}−{(Cc+5)−(Cc)}, expressed on the JIS-C hardness scale, may be set to preferably at least 0, more preferably at least 2, and even more preferably at least 5. Although there is no particular upper limit, the JIS-C hardness may be set to preferably not more than 15, more preferably not more than 13, and even more preferably not more than 10. When the above value is too small, the spin rate may rise excessively and a good distance may not be achieved. On the other hand, when this value is too large, the durability to cracking on repeated impact may worsen.

The core has a deflection when compressed under a final load of 1,275 N (130 kgf) from an initial load of 98 N (10 kgf) which, although not particularly limited, is preferably at least 3.9 mm, more preferably at least 4.05 mm, and even more preferably at least 4.2 mm. The upper limit may be set to preferably not more than 5.0 mm, and more preferably not more than 4.6 mm. When the core is harder than this range (the deflection is too small), the spin rate may rise excessively and a good distance may not be achieved, or the ball may have too hard a feel at impact. On the other hand, when the core is softer than this range (large deflection), the rebound may be too low and a good distance may not be achieved, or the feel at impact may be too soft and the durability to cracking on repeated impact may worsen.

Next, the intermediate layer is described. In this invention, the intermediate layer is formed of a resin material. In particular, various types of thermoplastic resin materials may be suitably used. For example, the use of ionomer resin materials or any of the subsequently mentioned highly neutralized resin materials is preferred as the intermediate layer material.

Illustrative examples of ionomer resin materials include sodium-neutralized ionomer resins such as Himilan® 1605, Himilan® 1601 and Surlyn® 8120, and zinc-neutralized ionomer resins such as Himilan® 1557 and Himilan® 1706. These may be used singly or two or more may be used together.

It is desirable to blend a high-acid ionomer in the above ionomer resin material. In this case, the content of the unsaturated carboxylic acid included in the high-acid ionomer material (acid content) is preferably at least 16 wt %, more preferably at least 17 wt %, and even more preferably at least 18 wt %. The upper limit is preferably not more than 22 wt %, more preferably not more than 21 wt %, and even more preferably not more than 20 wt %. When this acid content is too small, the spin rate may rise on full shots, as a result of which the intended distance may not be obtained.

On the other hand, when this value is too large, the feel at impact may become too hard or the durability to cracking on repeated impact may worsen.

Also, suitable use may be made of, as the highly neutralized resin material, a material formed primarily of a resin composition containing:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer blended with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (B) a non-ionomeric thermoplastic elastomer in a weight ratio between 100:0 and 50:50;

(C) from 5 to 120 parts by weight of a fatty acid and/or fatty acid derivative having a molecular weight of from 228 to 1,500; and (D) from 0.1 to 17 parts by weight of a basic inorganic metal compound capable of neutralizing un-neutralized acid groups in components A and C.

Components A to D are described below.

Component A, which is the base resin of the intermediate layer-forming resin composition, consists of: (a-1) an olefin-unsaturated carboxylic acid random copolymer and/or a metal ion neutralization product of an olefin-unsaturated carboxylic acid random copolymer, and (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer.

The olefins in components (a-1) and (a-2) are olefins in which the number of carbons is generally at least 2 but not more than 8, and preferably not more than 6. Specific examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are especially preferred.

The unsaturated carboxylic acid ester in component (a-2) is exemplified by lower alkyl esters of the above unsaturated carboxylic acids. Illustrative examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, i-butyl acrylate) is especially preferred.

The olefin-unsaturated carboxylic acid random copolymer of component (a-1) and the olefin-unsaturated carboxylic acid-unsaturated carboxylic acid ester random terpolymer of above component (a-2) (these are sometimes collectively referred to below as "random copolymers") can each be obtained by using a known method to random copolymerize the above-described olefin, unsaturated carboxylic acid and, where necessary, unsaturated carboxylic acid ester.

It is desirable for each of the above random copolymers to have a controlled content of unsaturated carboxylic acid (acid content). Specifically, it is recommended that the content of unsaturated carboxylic acid in component (a-1) be preferably at least 4 wt %, more preferably at least 6 wt %, even more preferably at least 8 wt %, and most preferably at least 10 wt %, but preferably not more than 30 wt %, more preferably not more than 20 wt %, even more preferably not more than 18 wt %, and most preferably not more than 15 wt %. It is recommended that the content of unsaturated carboxylic acid in component (a-2) be preferably at least 4 wt %, more preferably at least 6 wt %, and even more preferably at least 8 wt %, but preferably not more than 15 wt %, more preferably not more than 12 wt %, and even more preferably not more than 10 wt %. If the unsaturated carboxylic acid content in component (a-1) and/or component (a-2) is too low, the resilience may decrease, whereas if it is too high, the processability of the resin material may decrease.

The metal ion neutralization product of an olefin-unsaturated carboxylic acid random copolymer in component (a-1) and the metal ion neutralization product of an olefin-unsaturated carboxylic acid-unsaturated carboxylic acid ester random terpolymer in component (a-2) (these are collectively referred to below as "metal ion neutralization products of random copolymers") can be obtained by neutralizing some or all of the acid groups on the respective above random copolymers with metal ions.

Illustrative examples of metal ions for neutralizing acid groups in the above random copolymers include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. In the present invention, preferred use can be made of $Na^+$, $Li^+$, $Zn^{++}$ and $Mg^{++}$; $Mg^{++}$ and $Zn^{++}$ are especially recommended. The degree of neutralization of these random copolymers with the above metal ions is not subject to any particular limitation. These neutralization products may be obtained by a known method. For example, the above metal ions may be introduced into the random copolymers by using compounds such as formates, acetates, nitrates, carbonates, bicarbonates, oxides, hydroxides and alkoxides of these metal ions.

Commercially available products may be used as component A. Examples of commercial products that may be used as the random copolymer in component (a-1) include Nucrel® 1560, Nucrel® 1214 and Nucrel® 1035 (all products of DuPont-Mitsui Polychemicals Co., Ltd.), and Escor™ 5200, Escor™ 5100 and Escor™ 5000 (all products of ExxonMobil Chemical). Examples of commercial products that may be used as the metal ion neutralization product of the random copolymer in component (a-1) include Himilan® 1554, Himilan® 1557, Himilan® 1601, Himilan® 1605, Himilan® 1706 and Himilan® AM7311 (all products of DuPont-Mitsui Polychemicals Co., Ltd.), Surlyn® 7930 (E.I. DuPont de Nemours & Co.), and Iotek® 3110 and Iotek® 4200 (ExxonMobil Chemical). Examples of commercial products that may be used as the random copolymer in component (a-2) include Nucrel® AN4311, Nucrel® AN4318, Nucrel® AN4319 and Nucrel® AN4221C (all products of DuPont-Mitsui Polychemicals Co., Ltd.), and Escor™ ATX325, Escor™ ATX320 and Escor™ ATX310 (all products of ExxonMobil Chemical). Examples of commercial products that may be used as the metal ion neutralization product of the random copolymer in component (a-2) include Himilan® 1855, Himilan® 1856 and Himilan® AM7316 (all products of DuPont-Mitsui Polychemicals Co., Ltd.), Surlyn® 6320, Surlyn® 8320, Surlyn® 9320 and Surlyn® 8120 (all products of E.I. DuPont de Nemours & Co.), and Iotek® 7510 and Iotek® 7520 (both products of ExxonMobil Chemical). These may be used singly or in combinations of two or more thereof as the respective components.

Examples of sodium-neutralized ionomer resins which are suitable as metal ion neutralization products of the above random copolymers include Himilan® 1605, Himilan® 1601 and Surlyn® 8120.

Component (a-1) and component (a-2) may be used singly, or both may be used together, as the base resin of the resin composition for the intermediate layer. The two components are blended in a weight ratio of component (a-1) to component (a-2) of typically from 100:0 to 0:100, although a weight ratio of from 50:50 to 0:100 is preferred.

The non-ionomeric thermoplastic elastomer (B) is a component which is preferably included so as to further improve the feel of the golf ball at impact and the ball rebound. In this invention, the base resin (component A) and the non-ionomeric thermoplastic elastomer (component B) are sometimes referred to collectively as "the resin component." Examples of component B include olefin elastomers, styrene elastomers, polyester elastomers, urethane elastomers and polyamide elastomers. In the present invention, to further increase the rebound, it is especially preferable to use an olefin elastomer or a polyester elastomer. A commercially available product may be used as component B. Illustrative examples include the olefin elastomer Dynaron® (JSR Corporation) and the polyester elastomer Hytrel® (DuPont-Toray Co., Ltd.). These may be used singly or as combinations of two or more thereof.

The amount of component B included, expressed as the weight ratio with above component A, or A:B, may be set to between 100:0 and 50:50, preferably between 100:0 and 60:40. If component B accounts for more than 50 wt % of the resin component, the compatibility of the respective components may decrease, which may markedly lower the durability of the golf ball.

Component C is a fatty acid and/or fatty acid derivative having a molecular weight of at least 228. This is a component which helps to improve the flow properties of the resin composition. Compared with the thermoplastic resin in the above resin component, component C has a very low molecular weight and, by suitably adjusting the melt viscosity of the mixture, helps in particular to improve the flow properties. Because the fatty acid (or fatty acid derivative) of the invention includes a high content of acid groups (or derivatives thereof) having a molecular weight of at least 228, there is little loss of resilience due to addition.

The molecular weight of the fatty acid or fatty acid derivative of component C may be set to at least 228, preferably at least 256, more preferably at least 280, and even more preferably at least 300. The upper limit of the molecular weight may be set to not more than 1,500, preferably not more than 1,000, even more preferably not more than 600, and most preferably not more than 500. If the molecular weight is too low, the heat resistance cannot be improved and the acid group content becomes too high, which may result in a smaller flow-improving effect due to interactions with acid groups present in component A. On the other hand, if the molecular weight is too high, a distinct flow-improving effect may not be achieved.

It is preferable to use as the fatty acid of component C an unsaturated fatty acid containing a double bond or triple bond on the alkyl moiety, or a saturated fatty acid in which the bonds on the alkyl moiety are all single bonds. The number of carbon atoms on one molecule of the fatty acid may be set to at least 18, preferably at least 20, more preferably at least 22, and even more preferably at least 24. The upper limit in the number of carbon atoms may be set to not more than 80, preferably not more than 60, more preferably not more than 40, and even more preferably not more than 30. Too few carbon atoms, in addition to possibly resulting in a poor heat resistance, may also, by making the acid group content relatively high, lead to excessive interactions with acid groups present in the resin component, thereby diminishing the flow-improving effect. On the other hand, too many carbon atoms increases the molecular weight, as a result of which a distinct flow-improving effect may not be achieved.

Illustrative examples of the fatty acid of component C include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

The fatty acid derivative is exemplified by metallic soaps in which the proton on the acid group of the fatty acid has been replaced with a metal ion. Examples of metal ions that may be used in the metallic soap include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of the fatty acid derivative of component C include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred. These may be used singly or as combinations of two or more thereof.

The amount of component C included per 100 parts by weight of the above resin component which includes components A and B may be set to at least 5 parts by weight, preferably at least 10 parts by weight, more preferably at least 15 parts by weight, and even more preferably at least 18 parts by weight. The upper limit is set to not more than 120 parts by weight, preferably not more than 80 parts by weight, more preferably not more than 60 parts by weight, and even more preferably not more than 50 parts by weight. If the amount of component C included is too small, the melt viscosity may decrease, lowering the processability. On the other hand, if the amount of component C is too large, the durability may decrease.

In this invention, use may also be made of, as a mixture of the above-described components A and C, a known metallic soap-modified ionomer (see, for example, U.S. Pat. No. 5,312,857, U.S. Pat. No. 5,306,760, and WO 98/46671).

The basic inorganic metal compound of component D is included for the purpose of neutralizing acid groups in components A and C. If component D is not included, particularly in cases where a metal-modified ionomer resin alone (e.g., a metallic soap-modified ionomer resin mentioned in the above-cited patent publications, alone) is mixed under applied heat, the metallic soap and un-neutralized acid groups present on the ionomer undergo an exchange reaction as shown below, generating a fatty acid. Because this generated fatty acid has a low thermal stability and readily vaporizes during molding, not only does it cause molding defects, when the generated fatty acid deposits on the surface of the molding, it causes a marked decline in coating adhesion.

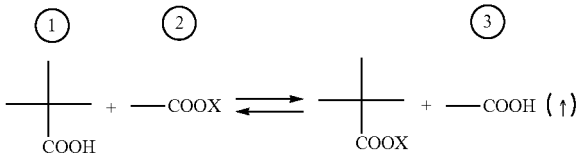

(1) un-neutralized acid group present on ionomer resin
(2) metallic soap
(3) fatty acid
X: metal atom Component D, which is a basic inorganic metal compound that neutralizes the acid groups present on components A and C, is included as an essential ingredient in order to resolve the above problems. By including component D, acid groups on components A and C are neutralized. Owing to synergistic effects arising from blending these ingredients, the thermal stability of the resin composition increases and, at the same time, a good moldability is imparted, thereby conferring the excellent property of enhancing resilience as a golf ball material.

It is recommended that component D be a basic inorganic metal compound which can neutralize acid groups in components A and C, preferably a monoxide. Because it has a high reactivity with the ionomer resin and the reaction by-products contain no organic matter, the degree of neutralization of the resin composition can be increased without a loss of thermal stability.

Illustrative examples of the metal ion used here in the basic inorganic metal compound include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Basic inorganic fillers containing these metal ions may be used as the inorganic metal compound. Illustrative examples include magnesium oxide, magnesium hydroxide, magnesium carbonate, zinc oxide, sodium hydroxide, sodium carbonate, calcium oxide, calcium hydroxide, lithium hydroxide and lithium carbonate. These may be used singly or as combinations of two or more thereof. In the present invention, of the above, a hydroxide or a monoxide is especially recommended. Calcium hydroxide and magnesium oxide, which have a high reactivity with component A, are preferred.

The amount of component D included per 100 parts by weight of the resin component may be set to at least 0.1 part by weight, preferably at least 0.5 part by weight, more preferably at least 1 part by weight, and even more preferably at least 2 parts by weight. The upper limit is not more than 17 parts by weight, preferably not more than 15 parts by to weight, more preferably not more than 13 parts by weight, and even more preferably not more than 10 parts by weight. If the amount of component D included is too small, improvements in the thermal stability and resilience may not be observed. On the other hand, if it is too large, the presence of excessive basic inorganic metal compound may have the opposite effect of lowering the heat resistance of the composition.

The mixture obtained by mixing components A to D has a degree of neutralization, based on the total amount of acid groups in the mixture, which is set to at least 50 mol %, preferably at least 60 mol %, more preferably at least 70 mol %, and even more preferably at least 80 mol %. With such a high degree of neutralization, even in cases where, for example, a metallic soap-modified ionomer resin is used, exchange reactions between the metallic soap and un-neutralized acid groups present in the ionomer resin are less likely to arise during mixture under heating, thereby reducing the likelihood of declines in thermal stability, moldability and resilience.

Various additives may be optionally included within the resin composition containing components A to D. For example, additives such as pigments, dispersants, antioxidants, ultraviolet absorbers and light stabilizers may be suitably included. These additives are used in an amount which, although not particularly limited, is generally at least 0.1 part by weight, preferably at least 0.5 part by weight, and more preferably at least 1 part by weight, per 100 parts by weight of the resin component. The upper limit is not more than 10 parts by weight, preferably not more than 6 parts by weight, and more preferably not more than 4 parts by weight.

The resin composition may be obtained by mixing together above components A to D under applied heat. For example, the resin composition may be obtained by mixture using a known mixing apparatus, such as a kneading-type twin-screw extruder, a Banbury mixer or a kneader, at a heating temperature between 150° C. and 250° C. Alternatively, direct use may be made of a commercial product, illustrative examples of which include those available under the trade names HPF 1000, HPF 2000 and HPF AD1027, as well as the experimental material HPF SEP1264-3, all produced by E.I. DuPont de Nemours & Co.

The method of forming the intermediate layer may be a known method and is not particularly limited. For example, use may be made of a method which involves setting a prefabricated core within a mold, and then injection-molding the resin composition prepared as described above over the core.

With regard to the intermediate layer material, as subsequently described, it is suitable to abrade the surface of the intermediate layer in order to increase adhesion with the polyurethane that is preferably used in the cover (outermost layer). In addition, it is preferable to apply a primer (adhesive) to the surface of the intermediate layer following such abrasion treatment or to add an adhesion reinforcing agent to the material.

The specific gravity of the intermediate layer material is typically less than 1.1, preferably from 0.90 to 1.05, and more preferably from 0.93 to 0.99. Outside of this range, the rebound may decrease and so an increased distance may not be achieved, or the durability to cracking on repeated impact may worsen.

The intermediate layer has a material hardness on the Shore D hardness scale which, although not particularly limited, is preferably at least 63, more preferably at least 64, and even more preferably at least 65. The upper limit is preferably not more than 70, more preferably not more than 68, and even more preferably not more than 66. The sphere obtained by encasing the core with the intermediate layer (referred to below as the "intermediate layer-encased sphere") has a surface hardness on the Shore hardness scale of preferably at least 69, more preferably at least 70, and even more preferably at least 71. The upper limit is preferably not more than 76, more preferably not more than 74, and even more preferably not more than 72. When the intermediate layer-encased sphere is softer than this range, on full shots the rebound may be inadequate or the ball may be too receptive to spin, as a result of which a good distance may not be achieved. On the other hand, when the intermediate layer-encased sphere is harder than this range, the durability to cracking on repeated impact may worsen or the ball may have too hard a feel at impact.

In this invention, from the standpoint of achieving both a soft feel at impact and a high durability to repeated impact, the (intermediate layer thickness)/(core diameter) value is to set in the range of from 0.025 to 0.043. The (intermediate layer thickness)/(core diameter) value is preferably from 0.028 to 0.041, and more preferably from 0.031 to 0.039. When this value is too small, the durability to cracking on repeated impact may worsen. On the other hand, when this value is too large, the feel of the ball at impact may be hard.

Next, the cover, which is the outermost layer of the ball, is described.

In this invention, for reasons having to do with ball controllability and scuff resistance, a urethane resin material is used in the cover. In particular, from the standpoint of the mass productivity of manufactured balls, it is preferable to use a cover material composed primarily of a thermoplastic polyurethane, with formation being preferably carried out using a resin blend in which the primary components are (X) a thermoplastic polyurethane and (Y) a polyisocyanate compound.

In order to fully and effectively exhibit the advantages of the invention, a necessary and sufficient amount of unreacted isocyanate groups should be present within the cover resin material. Specifically, it is recommended that the combined weight of components X and Y be at least 60%, and more preferably at least 70%, of the weight of the overall cover. Components X and Y are described below in detail.

The thermoplastic polyurethane (X) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be suitably used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, the chain extender is preferably an aliphatic diol having 2 to 12 carbon atoms, and more preferably 1,4-butylene glycol.

Any polyisocyanate compound hitherto employed in the art relating to thermoplastic polyurethanes may be suitably used without particular limitation as the polyisocyanate compound. For example, use may be made of one, two or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reactions during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component (X). Illustrative examples include Pandex T-8295, Pandex T-8290, Pandex T-8260 and Pandex T-8283 (all from DIC Bayer Polymer, Ltd.).

Although not an essential ingredient, a thermoplastic elastomer other than the above thermoplastic polyurethane may be included as component Z together with components X and Y. By including this component Z in the above resin blend, a further improvement in the flowability of the resin blend can be achieved and the properties required of a golf ball cover material, such as resilience and scuff resistance, can be enhanced.

The relative proportions of above components X, Y and Z are not particularly limited. However, to fully elicit the advantageous effects of the invention, the weight ratio X:Y:Z is preferably from 100:2:50 to 100:50:0, and more preferably from 100:2:50 to 100:30:8.

In addition to the ingredients making up the thermoplastic polyurethane, various additives may be optionally included in the above resin blend. For example, pigments, dispersants, antioxidants, light stabilizers, ultraviolet absorbers and internal mold lubricants may be suitably included.

The cover has a material hardness on the Shore D hardness scale which, although not particularly limited, is preferably at least 35, and more preferably at least 40, with the upper limit being preferably not more than 55, more preferably not more than 53, and even more preferably not more than 50. Also, the surface hardness of the sphere obtained by encasing the above intermediate layer-encased sphere with the cover, i.e., the surface hardness of the ball, on the Shore D hardness scale is preferably at least 40, and more preferably at least 50, with the upper limit being preferably not more than 62, more preferably not more than 61, and even more preferably not more than 60. When the surface hardness is lower than this range, the spin rate on W#1 shots becomes too high, as a result of which a good distance may not be achieved.

In this invention, in order to achieve both an excellent flight performance and a high productivity, the (cover thickness)/(core diameter) value is set in the range of from 0.014 to 0.027. The (cover thickness)/(core diameter) value is preferably from 0.017 to 0.024, and more preferably from 0.020 to 0.022. When this value is too small, the cover formability may worsen, the scuff resistance may worsen, the ball may not be receptive to spin on approach shots and the controllability may be poor. On the other hand, when this value is too large, the rebound on full shots with a W#1 or an iron may be inadequate or the spin rate may be too high, as a result of which a good distance may not be achieved.

In addition, the golf ball of the invention preferably satisfies the following conditions.

(1) Relationship Between Initial Velocity of Core and Initial Velocity of Intermediate Layer-Encased Sphere In order for the ball interior to have a high resilience and a high durability, it is an essential condition of the inventive golf ball for the sphere consisting of the core encased by the intermediate layer (intermediate layer-encased sphere) to have an initial velocity A and for the core to have an initial velocity B which together satisfy the condition $A-B \geq 0$ m/s. That is, the value obtained by subtracting the initial velocity of the core from the initial velocity of the intermediate layer-encased sphere is at least 0 m/s, preferably at least 0.1 m/s, and more preferably at least 0.2 m/s, and has an upper limit of preferably not more than 0.8 m/s, and more preferably not more than 0.5 m/s. When this value is too small, the ball rebound may be too low and the spin rate may rise excessively, as a result of which a good distance may not be achieved. On the other hand, when this value is too large, the durability to cracking on repeated impact may worsen considerably. The measurement apparatus and conditions shown in the subsequently described examples are used for measuring the initial velocities of the respective spheres.

(2) Initial Velocity of Core, Initial Velocity of Intermediate Layer-Encased Sphere and Initial Velocity of Ball The relationship among the initial velocities of the core, the intermediate layer-encased sphere and the ball preferably satisfies the condition:

initial velocity of intermediate layer-encased sphere≥initial velocity of core>initial velocity of ball, and more preferably satisfies the condition:

initial velocity of intermediate layer-encased sphere>initial velocity of core>initial velocity of ball.

When this condition is not satisfied, the ball rebound may become lower and it may not be possible to retain an optimal spin rate on full shots, as a result of which a good distance may not be achieved.

(3) Surface Hardness of Intermediate Layer-Encased Sphere and Surface Hardness of Core The value obtained by subtracting the core surface hardness from the surface hardness of the intermediate layer-encased sphere, expressed on the Shore D hardness scale, is preferably at least 6, more preferably at least 8, and even more preferably at least 10. The upper limit in this value is preferably not more than 24, more preferably not more than 20, and even more preferably not more than 18. When this value is too small, the spin rate may rise excessively and a good distance may not be obtained. On the other hand, when this value is too large, the durability to cracking on repeated impact may worsen.

(4) Surface Hardness of Ball and Surface Hardness of Intermediate Layer-Encased Sphere The value obtained by subtracting the surface hardness of the intermediate layer-encased sphere from the surface hardness of the ball, expressed on the Shore D hardness scale, is preferably at least −25, and more preferably at least −20. The upper limit is preferably not more than 0, more preferably not more than −4, and even more preferably not more than −8. When this value is too small (too large in the negative direction), the spin rate may rise excessively and a good distance may not be achieved. On the other hand, when this value is too large (in the positive direction), the controllability in the short game may be inadequate or the feel at impact may become too poor.

(5) Surface Hardness of Core and Surface Hardness of Ball

The value obtained by subtracting the surface hardness of the ball from the surface hardness of the core, expressed on the Shore D hardness scale, is preferably at least −11, more preferably at least −8, and even more preferably at least −5. The upper limit is preferably not more than 6, more preferably not more than 3, and even more preferably not more than 0. When this value is too small (too large in the negative direction), the controllability in the short game may worsen or the durability to cracking on repeated impact may worsen. On the other hand, when this value is too large, the feel at impact may worsen.

(6) Relationship Between Intermediate Layer Thickness and Cover Thickness

The balance between the thicknesses of the intermediate layer and the cover is set within a specific range. That is, the value obtained by subtracting the cover thickness from the intermediate layer thickness is preferably at least 0 mm, more preferably at least 0.2 mm, and even more preferably at least 0.4 mm. The upper limit is preferably not more than 1.5 mm, more preferably not more than 1.1 mm, and even more preferably not more than 0.8 mm. When this value is too small, the spin rate on full shots may rise excessively, as a result of which a good distance may not be achieved. On the other hand, when this value is too large, the feel at impact may become too hard.

Numerous dimples may be formed on the outer surface of the cover. The number of dimples arranged on the cover surface, although not particularly limited, is preferably at least 250, more preferably at least 300, and even more preferably at least 320, with the upper limit being preferably not more than 380, more preferably not more than 350, and even more preferably not more than 340. When the number of dimples is higher than this range, the ball trajectory may become low, as a result of which the distance traveled by the ball may decrease. On the other hand, when the number of dimples is lower than this range, the ball trajectory may become high, as a result of which a good distance may not be achieved.

With regard to the types of dimples, it is recommended that preferably at least two types, and more preferably at least three types, of dimples of mutually differing diameter and/or depth be formed. The dimple shapes that are used may be of one type or may be a combination of two or more types suitably selected from among circular shapes, various polygonal shapes, dewdrop shapes and oval shapes. When circular dimples are used, the dimple diameter may be set to at least about 2.5 mm and up to about 6.5 mm, and the dimple depth may be set to at least 0.08 mm and up to 0.30 mm.

In order to be able to fully manifest the aerodynamic properties of the dimples, it is desirable for the dimple coverage ratio on the spherical surface of the golf ball, i.e., the dimple surface coverage SR, defined as the proportion of the ball surface accounted for by the total surface area of the hypothetical spherical surfaces circumscribed by the edges of the individual dimples, to be set to at least 70% and not more than 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of the dimple, with respect to the volume of the ball sphere were the ball surface to have no dimples thereon, to be set to at least 0.6% and not more than 1.0%. Outside of the above ranges in these respective values, the resulting trajectory may not enable a good distance to be obtained, and so the ball may fail to travel a fully satisfactory distance.

In this invention, by optimizing the cross-sectional shape of the dimples, the variability in flight can be reduced and the aerodynamic performance improved. That is, by holding the ratio of change in depth at a given position in a dimple within a fixed range, the dimple effect is stabilized, enabling the aerodynamic performance to be enhanced. Specifically, it is preferable for the cross-sectional shapes of the above dimples to satisfy the following conditions. The conditions are explained below.

Figure 2:
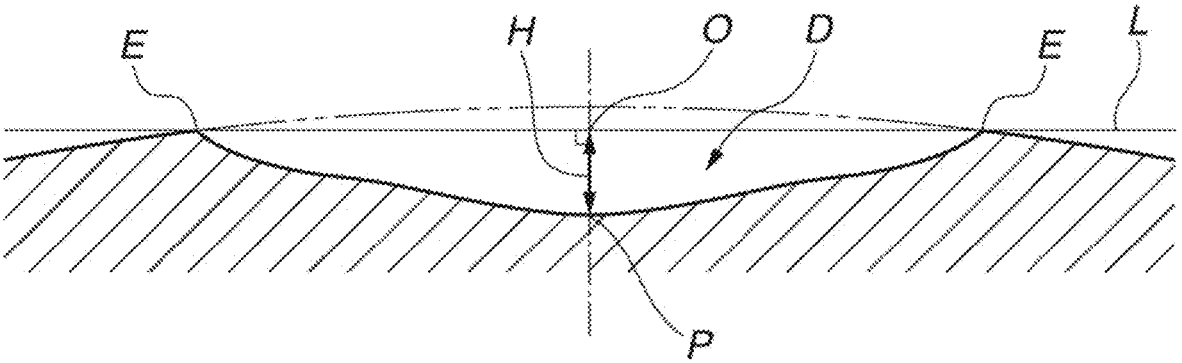
FIG. 2 is an enlarged cross-sectional view of one dimple formed on the surface of the golf ball.
Figure 3:
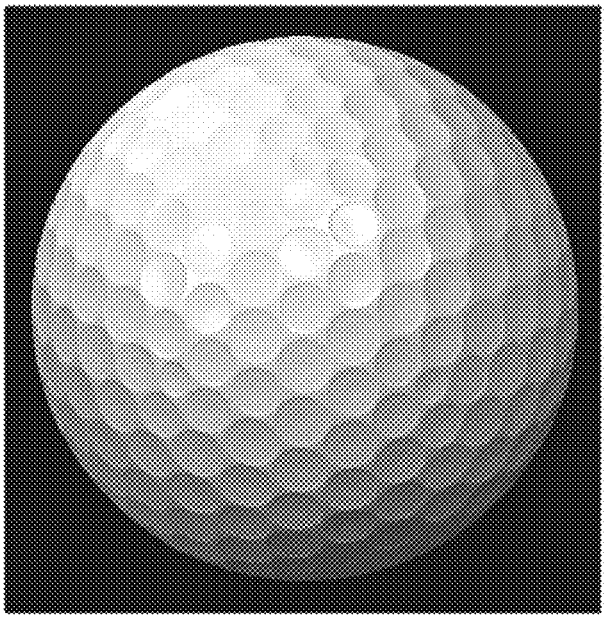
FIG. 3 is a plan view showing the dimple pattern used on the balls in the Working Examples and the Comparative Examples.

First, as condition (i), referring to the enlarged cross-sectional view of a single dimple in FIG. 2, let the foot of a perpendicular drawn from a deepest point P of the dimple D to an imaginary plane defined by a peripheral edge of the dimple be the dimple center 0, and let a straight line that passes through the dimple center 0 and any one dimple edge E be the reference line L.

Figure 4:
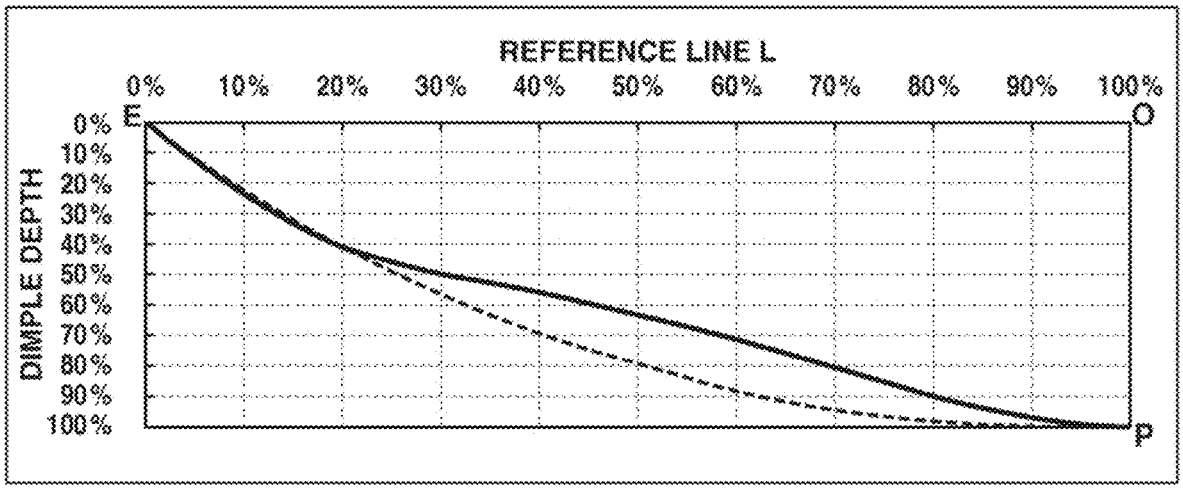
FIG. 4 is a graph showing the relationship between the dimple cross-section and regions established at the interior of the dimple.

Next, as condition (ii), divide a segment of the reference line L from the dimple edge E to the dimple center O into at least 100 points. Then compute the distance ratio for each point when the distance from the dimple edge to the dimple center is set to 100%. That is, referring to FIG. 4, the dashed lines in the chart are dividing lines represented along the dimple depth. The dimple edge E is the origin, which is the 0% position on the reference line, and the dimple center O is the 100% position with respect to segment EO on the reference line.

Next, as condition (iii), compute the dimple depth ratio at every 20% from 0 to 100% of the distance from the dimple edge E to the dimple center O. In this case, the dimple center O is at the deepest part P of the dimple and has a depth H (mm). Letting this be 100% of the depth, the dimple depth ratio at each distance is determined. Also, the dimple depth ratio at the dimple edge E becomes 0%.

Next, as condition (iv), at the depth ratios in dimple regions 20 to 100% of the distance from the dimple edge E to the dimple center O, determine the change in depth ΔH every 20% of the distance and design a dimple cross-sectional shape such that the change ΔH is at least 6% and not more than 24% in all regions corresponding to from 20 to 100% of the distance.

By quantifying the cross-sectional shape of the dimple in this way, that is, by setting the change in dimple depth ΔH to at least 6% and not more than 24%, and thereby optimizing the dimple cross-sectional shape, the flight variability decreases, enhancing the aerodynamic performance of the ball. This change ΔH is preferably from 8 to 22%, and more preferably from 10 to 20%.

Also, to further increase the advantageous effects of the invention, in dimples having the specified cross-sectional shape, it is preferable for the change in dimple depth ΔH to reach a maximum at 20% of the distance from the dimple edge E to the dimple center O. Also, the inclusion of two or more points of inflection on the curved line describing the specified cross-sectional shape of the dimple is preferable in terms of increasing the advantageous effects of the invention.

It is preferable for dimples having the above-described cross-sectional shape to account for some portion of all the dimples. In such a case, the dimples having the above-described cross-sectional shape account for a proportion of the total number of dimples formed on the ball surface which, although not particularly limited, may be set to 20% or more, preferably 50% or more, more preferably 60% or more, even more preferably 80% or more, and most preferably 100%.

To ensure a good ball appearance, it is preferable to apply a clear coating onto the cover surface. It is suitable for the coating composition used in clear coating to be one which uses two types of polyester polyol as the base resin and uses a polyisocyanate as the curing agent. In this case, various types of organic solvents can be admixed depending on the intended coating conditions. Examples of such organic solvents that can be used include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methyl cyclohexane and ethyl cyclohexane; and petroleum hydrocarbon-based solvents such as mineral spirits.

The coating layer obtained by clear coating has a thickness of typically from 9 to 22 μm, preferably from 11 to 20 μm, and more preferably from 13 to 18 μm.

The coating layer obtained by clear coating has a hardness Hc which, on the JIS-C hardness scale, is preferably from 40 to 80, more preferably from 47 to 72, and even more preferably from 55 to 65. If the coating layer is too soft, mud may tend to stick to the surface of the ball when used for golfing. On the other hand, when the coating layer is too hard, it may tend to peel off when the ball is struck.

It is preferable for the relationship between the hardness Hc of the coating layer and the hardness 5 mm inside of the core surface (Cs−5) to satisfy the condition $[(Cs-5)-Hc] \geq 0$. The lower limit in the value $[(Cs-5)-Hc]$ in this formula is preferably at least 5, more preferably at least 7, and even more preferably at least 9. The upper limit is preferably not more than 18, more preferably not more than 14, and even more preferably not more than 12. When this value falls outside of the above range, the spin rate of the ball on full shots increases and a good distance may not be obtained.

The multi-piece solid golf ball of the invention can be made to conform to the Rules of Golf for play. Specifically, the inventive ball may be formed to a diameter which is such that the ball does not pass through a ring having an inner diameter of 42.672 mm and is not more than 42.80 mm, and to a weight which is preferably from 45.0 to 45.93 g.

EXAMPLES

The following Working Examples and Comparative Examples are provided to illustrate the invention, and are not intended to limit the scope thereof

Examples 1 to 7, Comparative Examples 1 to 6

Formation of Core

Solid cores having specific diameters were produced by preparing the rubber compositions shown in Table 1 below, and then molding and vulcanizing the compositions under vulcanization conditions of 155° C. and 15 minutes.

TABLE 1

| | | Working Example | | | | | | | Comparative Example | | | | | |
|---|---|---|---|---|---|---|---|---|---|---|---|---|---|---|
| | | 1 | 2 | 3 | 4 | 5 | 6 | 7 | 1 | 2 | 3 | 4 | 5 | 6 |
| Core formulation | Polybutadiene A | 20 | 20 | 20 | 20 | 20 | 20 | 20 | 20 | 20 | 20 | 20 | 20 | 20 |
| | Polybutadiene B | 80 | 80 | 80 | 80 | 80 | 80 | 80 | 80 | 80 | 80 | 80 | 80 | 80 |
| | Zinc acrylate | 39.3 | 36.6 | 39.3 | 36.6 | 39.3 | 36.6 | 33.9 | 36.6 | 39.3 | 39.3 | 39.3 | 39.3 | 39.3 |
| | Organic peroxide | 0.6 | 0.6 | 0.6 | 0.6 | 0.6 | 0.6 | 0.6 | 0.6 | 0.6 | 0.6 | 0.6 | 0.6 | 0.6 |
| | Water | 0.8 | 0.8 | 0.8 | 0.8 | 0.8 | 0.8 | 0.8 | 0.8 | 0.8 | 0.8 | 0.8 | 0.8 | 0.8 |
| | Antioxidant | 0.1 | 0.1 | 0.1 | 0.1 | 0.1 | 0.1 | 0.1 | 0.1 | 0.1 | 0.1 | 0.1 | 0.1 | 0.1 |
| | Zinc oxide | 20.4 | 21.4 | 20.4 | 21.4 | 20.4 | 21.4 | 21.4 | 19.5 | 21.6 | 20.1 | 20.6 | 20.4 | 20.4 |
| | Zinc salt of pentachlorothiophenol | 1 | 1 | 1 | 1 | 1 | 1 | 1 | 1 | 1 | 1 | 1 | 1 | 1 |

The numbers in Table 1 indicate parts by weight. Details on the core materials are given below.

Polybutadiene A: Available under the trade name "BR 51" from JSR Corporation

Polybutadiene B: Available under the trade name "BR 730" from JSR Corporation

Zinc acrylate: Available from Wako Pure Chemical Industries, Ltd.

Organic peroxide: Dicumyl peroxide, available under the trade name "Percumyl D" from NOF Corporation Antioxidant: 2,2'-Methylenebis(4-methyl-6-butylphenol), available under the trade name "Nocrac NS-6" from Ouchi Shinko Chemical Industry Co., Ltd.

Zinc oxide: Available as "Zinc Oxide Grade 3" from Sakai Chemical Co., Ltd.

Zinc salt of pentachlorothiophenol: Available from Wako Pure Chemical Industries, Ltd.

Formation of Intermediate Layer and Cover

Next, using the various resin components formulated as shown in Table 2, an intermediate layer and a cover were successively injection-molded over the core obtained above, thereby producing three-piece solid golf balls having an intermediate layer and a cover over a core.

TABLE 2

| Resin Material | No. 1 | No. 2 | No. 3 | No. 4 | No. 5 | No. 6 |
|---|---|---|---|---|---|---|
| T-8295 | | | | | 100 | |
| T-8290 | | | | 37.5 | | |
| T-8283 | | | | 62.5 | | |
| Surlyn ® 9150 | | 50 | | | | |
| AM7318 | | 50 | | | | 50 |
| AM7315 | | | | | | 50 |
| Himilan ® 1706 | 35 | | | | | |
| Himilan ® 1557 | 15 | | 50 | | | |
| Himilan ® 1605 | 50 | | | | | |
| Himilan ® 1601 | | | 50 | | | |
| Himilan ® 4001 | | | | 11 | 11 | |
| Titanium oxide | | | | 3.9 | 3.9 | |
| Polyethylene wax | | | | 1.2 | 1.2 | |

TABLE 2-continued

| Resin Material | No. 1 | No. 2 | No. 3 | No. 4 | No. 5 | No. 6 |
|---|---|---|---|---|---|---|
| Isocyanate compound | | | | 7.5 | 7.5 | |
| Trimethylolpropane | 1.1 | 1.1 | 1.1 | | | 1.1 |

The numbers in Table 2 indicate parts by weight. Details on the above materials are given below.

T-8295, T-8290, T-8283: MDI-PTMG type thermoplastic polyurethanes available from DIC Bayer Polymer under the trade name Pandex Surlyn® 9150: An ionomer available from E.I. DuPont de Nemours & Co.

AM7318, AM7315: Ionomers available from DuPont-Mitsui Polychemicals Co., Ltd. under the trademark Himilan®.

Hytrel® 4001: A thermoplastic polyester elastomer available from DuPont-Toray Co., Ltd.

Polyethylene wax: Available under the trade name "Sanwax 161P" from Sanyo Chemical Industries, Ltd.

Isocyanate compound: 4,4-Diphenylmethane diisocyanate

[Dimples]

Two families of dimples were used on the ball surface: A and B.

Family A

Figure 5A:
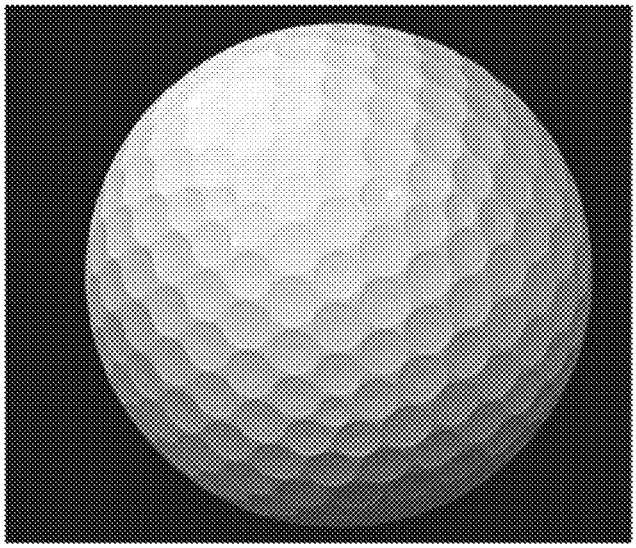
FIG. 5A is a plan view showing the appearance of a golf ball on the surface of which have been formed the dimples used in Working Examples 1 to 6 and Comparative Examples 1 to 6.

Family A includes four types of dimples, details of which are shown in Table 3. FIG. 5A is a plan view showing the appearance of a golf ball having Family A dimples, and FIG. 5B is an enlarged cross-sectional view of one of these dimples.

Family B

Figure 6A:
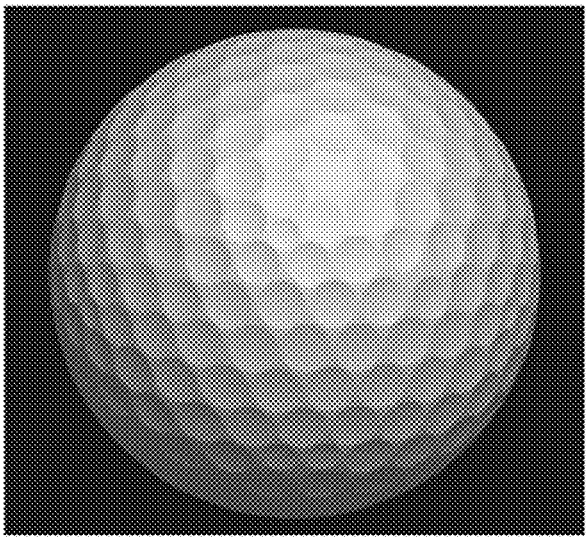
FIG. 6A is a plan view showing the appearance of a golf ball on the surface of which have been formed the dimples used in Working Example 7.

Family B includes four types of dimples, details of which are shown in Table 4. FIG. 6A is a plan view showing the appearance of a golf ball having Family B dimples, and FIG. 6B is an enlarged cross-sectional view of one of these dimples.

Figure 5B:
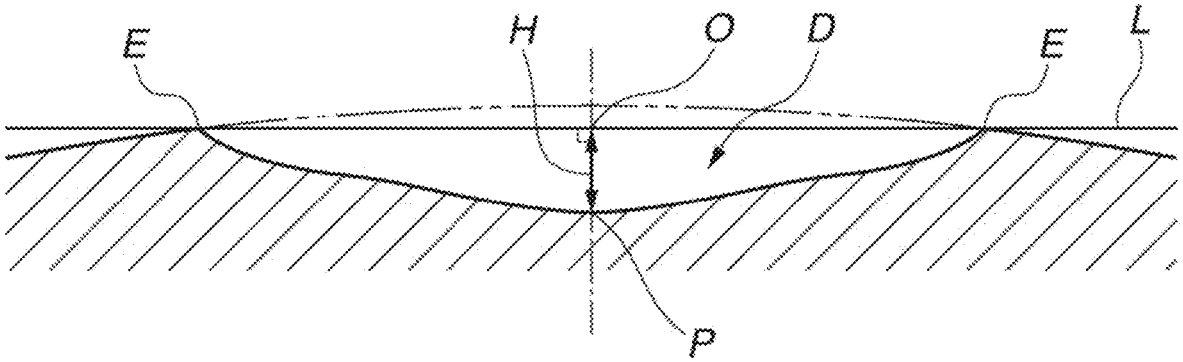
FIG. 5B is an enlarged cross-sectional view of one dimple formed on the surface of the golf ball shown in FIG. 5A.
Figure 6B:
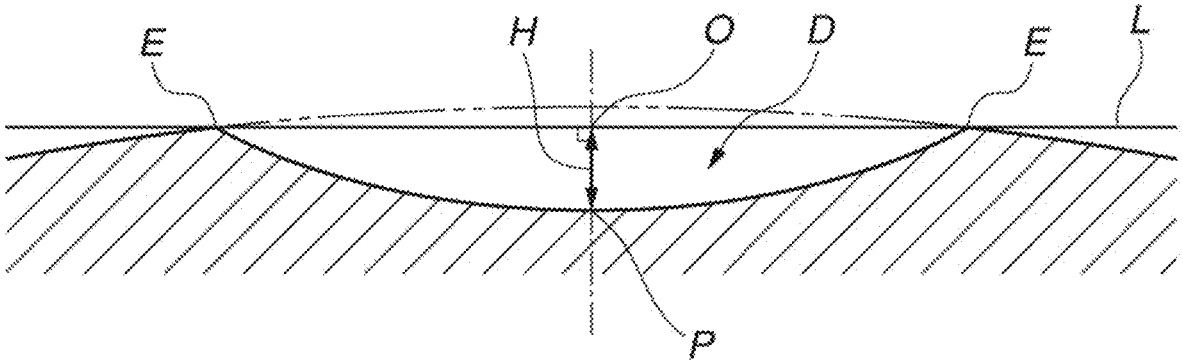
FIG. 6B is an enlarged cross-sectional view of one dimple formed on the surface of the golf ball shown in FIG. 6A.

In the respective dimple cross-sectional shapes in FIGS. 5B and 6B, the depth of the dimple from the reference line L to the inside wall of the dimple was determined at 100 equally spaced points on the reference line L from the dimple edge E to the dimple center O. The results are presented in Tables 3 and 4.

Next, the change in dimple depth ΔH every 20% of the distance along the reference line L from the dimple edge E was determined. These values too are presented in Tables 3 and 4.

TABLE 3

Family A

| Dimple type | | No. 1 | No. 2 | No. 3 | No. 4 |
|---|---|---|---|---|---|
| Number of dimples | | 240 | 72 | 12 | 14 |
| Diameter (mm) | | 4.3 | 3.8 | 2.8 | 4.0 |
| Depth at point of maximum depth (mm) | | 0.15 | 0.16 | 0.17 | 0.16 |
| Dimple depths at each point (mm) | 20% | 0.06 | 0.07 | 0.07 | 0.08 |
| | 40% | 0.08 | 0.09 | 0.09 | 0.11 |
| | 60% | 0.11 | 0.11 | 0.12 | 0.11 |
| | 80% | 0.13 | 0.14 | 0.15 | 0.14 |
| | 100% | 0.15 | 0.16 | 0.17 | 0.16 |
| Change in dimple depth (%) | 0%-20% | 41 | 41 | 41 | 52 |
| | 20%-40% | 15 | 15 | 15 | 15 |
| | 40%-60% | 15 | 15 | 15 | 2 |
| | 60%-80% | 19 | 19 | 19 | 19 |
| | 80%-100% | 10 | 10 | 10 | 12 |
| SR (%) | | 80 | | | |
| VR (%) | | 0.9 | | | |
| Percent of dimples having specified shape | | 96 | | | |

TABLE 4

Family B

| Dimple type | | No. 1 | No. 2 | No. 3 | No. 4 |
|---|---|---|---|---|---|
| Number of dimples | | 240 | 72 | 12 | 14 |
| Diameter (mm) | | 4.3 | 3.8 | 2.8 | 4.0 |
| Depth at point of maximum depth (mm) | | 0.14 | 0.15 | 0.15 | 0.16 |
| Dimple depths at each point (mm) | 20% | 0.05 | 0.05 | 0.06 | 0.06 |
| | 40% | 0.09 | 0.10 | 0.10 | 0.11 |
| | 60% | 0.12 | 0.13 | 0.13 | 0.13 |
| | 80% | 0.14 | 0.14 | 0.14 | 0.15 |
| | 100% | 0.14 | 0.15 | 0.15 | 0.16 |
| Change in dimple depth (%) | 0%-20% | 35 | 37 | 37 | 38 |
| | 20%-40% | 30 | 33 | 31 | 29 |
| | 40%-60% | 21 | 17 | 18 | 17 |
| | 60%-80% | 11 | 10 | 10 | 11 |
| | 80%-100% | 4 | 4 | 3 | 5 |
| SR (%) | | 79 | | | |
| VR (%) | | 0.9 | | | |
| Percent of dimples having specified shape | | 0 | | | |

Dimple Definitions

Diameter: Diameter of flat plane circumscribed by edge of dimple.

Depth: Maximum depth of dimple from flat plane circumscribed by edge of dimple.

SR: Sum of individual dimple surface areas, each defined by the flat plane circumscribed by the edge of the dimple, as a percentage of the spherical surface area of the ball were the ball to have no dimples thereon.

Formation of Coating Layer

Next, using Coating Composition I shown in Table 5 below as a coating composition common to all the Working Examples and Comparative Examples, the coating was applied with an air spray gun onto the cover (outermost layer) surface having numerous dimples formed thereon, thereby producing a golf ball on which a 15 μm thick coating layer has been formed.

TABLE 5

| | | | |
|---|---|---|---|
| Coating composition I (amounts included are in parts by weight) | Base resin | Polyester polyol (A) | 23 |
| | | Polyester polyol (B) | 15 |
| | | Organic solvent | 62 |
| | Curing agent | Isocyanate (nurate-modified HMDI) | 42 |
| | | Solvent | 58 |
| | Molar ratio (NCO/OH) | | 0.89 |
| Coating properties | Elastic work recovery (%) | | 84 |
| | JIS-C hardness | | 63 |
| | Thickness (μm) | | 15 |

[Polyester Polyol (A) Synthesis Example]

A reactor equipped with a reflux condenser, a dropping funnel, a gas inlet and a thermometer was charged with 140 parts by weight of trimethylolpropane, 95 parts by weight of ethylene glycol, 157 parts by weight of adipic acid and 58 parts by weight of 1,4-cyclohexanedimethanol, following which, under stirring, the temperature was raised to between 200 and 240° C. and heating (reaction) was carried out for 5 hours, thereby giving Polyester Polyol (A) having an acid value of 4, a hydroxyl value of 170 and a weight-average molecular weight (Mw) of 28,000.

Next, a varnish having a nonvolatiles content of 70 wt % was prepared by dissolving with butyl acetate the Polyester Polyol (A) thus synthesized.

In Coating Composition I in Table 5, the base resin was obtained by mixing 15 parts by weight of Polyester Polyol (B) (the saturated aliphatic polyester polyol NIPPOLAN 800 from Tosoh Corporation; weight-average molecular weight (Mw), 1,000; solids content, 100%) and an organic solvent together with 23 parts by weight of the polyester polyol solution prepared above. This mixture had a nonvolatiles content of 38.0 wt %.

Elastic Work Recovery

The elastic work recovery of the coating was measured using a coating sheet having a thickness of 50 μm. The ENT-2100 nanohardness tester from Erionix Inc. was used as the measurement apparatus, and the measurement conditions were as follows.

Indenter: Berkovich indenter (material: diamond; angle α: 65.03°)

Load F: 0.2 mN

Loading time: 10 seconds

Holding time: 1 second

Unloading time: 10 seconds

The elastic work recovery was calculated as follows, based on the indentation work $W_{elast}$ (Nm) due to spring-back deformation of the coating and on the mechanical indentation work $W_{total}$ (Nm).

$$\text{Elastic work recovery}=W_{elast}/W_{total}\times 100(\%)$$

The following measurements and evaluations were carried out on the golf balls obtained above in the respective Working Examples and Comparative Examples. The results are shown in Table 6.

Diameter of Core and Intermediate Layer-Encased Sphere

The diameters at five random places on the surface were measured at a temperature of 23.9±1° C. and, using the average of these measurements as the measured value for a single core or intermediate layer-encased sphere, the average diameter for ten cores or intermediate layer-encased spheres was determined.

Diameter of Ball (Cover-Encased Sphere)

The diameters at 15 random, dimple-free areas on the surface of a ball were measured at a temperature of 23.9±1° C. and, using the average of these measurements as the measured value for a single ball, the average diameter for ten measured balls was determined.

Core Deflection

A core was placed on a steel plate and the amount of deflection when compressed under a final load of 1,275 N (130 kgf) from an initial load of 98 N (10 kgf) was measured. The amount of deflection here refers in each case to the measured value obtained after holding the test specimen isothermally at 23.9±1° C. for at least 3 hours.

Center Hardness (JIS-C Hardness) of Core (Cc)

The core center hardness was obtained by cutting the core in half through the center and measuring the hardness at the center of the resulting cross-section. The JIS-C hardness was measured with the spring-type durometer (JIS-C model) specified in JIS K 6301-1975.

Surface Hardness (JIS-C Hardness) of Core (Cs)

The core surface hardness was obtained by perpendicularly pressing the indenter of a durometer against the surface of the spherical core and measuring the hardness. The JIS-C hardness was measured with the spring-type durometer (JIS-C model) specified in JIS K 6301-1975. The core surface hardness was also measured on the Shore D hardness scale with a type D durometer in accordance with ASTM D2240-95.

Cross-Sectional Hardnesses (JIS-C Hardnesses) at Specific Positions in Core (1) The cross-sectional hardness at a position 5 mm outside the core center (Cc+5) was obtained by using the spring-type durometer (JIS-C model) specified in JIS K 6301-1975 to measure the hardness at a position 5 mm outside the center in a cross-section of the core obtained by cutting the core in half through the center.

(2) The cross-sectional hardness at a position 5 mm inside the core surface (Cs−5) was obtained by using the above durometer (JIS-C model) to measure the hardness at a position 5 mm inside the surface in a cross-section of the core obtained by cutting the core in half through the center.

Surface Hardnesses (Shore D Hardnesses) of Intermediate Layer-Encased Sphere and Ball (Cover-Encased Sphere)

Measurements were taken by pressing the durometer indenter perpendicularly against the surface of the intermediate layer-encased sphere or ball (cover). The surface hardness of the ball (cover-encased sphere) is the measured value obtained at dimple-free places (lands) on the ball surface. The Shore D hardnesses were measured with a type D durometer in accordance with ASTM D2240-95.

Material Hardnesses (Shore D Hardnesses) of Intermediate Layer and Cover

The intermediate layer and cover-forming resin materials were molded into sheets having a thickness of 2 mm and left to stand for at least two weeks, following which the Shore D hardnesses were measured in accordance with ASTM D2240-95.

Initial Velocities of Core, Intermediate Layer-Encased Sphere and Ball

The initial velocities were measured using an initial velocity measuring apparatus of the same type as the USGA drum rotation-type initial velocity instrument approved by The Royal and Ancient Golf Club of St. Andrews (R&A). The cores, intermediate layer-encased spheres and balls (cover-encased spheres), collectively referred to below as "spherical test specimens," were held isothermally in a 23.9±1° C. environment for at least 3 hours, and then tested in a room temperature (23.9±2° C.) chamber. Each spherical test specimen was hit using a 250-pound (113.4 kg) head (striking mass) at an impact velocity of 143.8 ft/s (43.83 m/s). One dozen spherical test specimens were each hit four times. The time taken for the test specimen to traverse a distance of 6.28 ft (1.91 m) was measured and used to compute the initial velocity (m/s). This cycle was carried out over a period of about 15 minutes.

TABLE 6

| | | | Working Example | | | | | | |
|---|---|---|---|---|---|---|---|---|---|
| | | | 1 | 2 | 3 | 4 | 5 | 6 | 7 |
| | | Construction | 3-piece | 3-piece | 3-piece | 3-piece | 3-piece | 3-piece | 3-piece |
| Core | | Diameter (mm) | 38.3 | 38.3 | 38.3 | 38.3 | 38.3 | 38.3 | 38.3 |
| | | Weight (g) | 33.72 | 33.72 | 33.72 | 33.72 | 33.72 | 33.72 | 33.72 |
| | | Specific gravity | 1.146 | 1.146 | 1.146 | 1.146 | 1.146 | 1.146 | 1.146 |
| | | Deflection (mm) | 4.2 | 4.5 | 4.2 | 4.5 | 4.2 | 4.5 | 4.5 |
| | Hardness profile (JIS-C) | Surface hardness (Cs) | 85 | 84 | 85 | 84 | 85 | 84 | 84 |
| | | Hardness 5 mm inside surface (Cs − 5) | 74 | 73 | 74 | 73 | 74 | 73 | 73 |
| | | Hardness 5 mm outside center (Cc + 5) | 60 | 58 | 60 | 58 | 60 | 58 | 58 |
| | | Center hardness (Cc) | 57 | 55 | 57 | 55 | 57 | 55 | 55 |
| | | Surface hardness − Center hardness (Cs − Cc) | 28 | 29 | 28 | 29 | 28 | 29 | 29 |
| | | Surface hardness − Hardness 5 mm inside surface (Cs) − (Cs − 5) | 11 | 11 | 11 | 11 | 11 | 11 | 11 |

TABLE 6-continued

| | | | | | | | | |
|---|---|---|---|---|---|---|---|---|
| | Hardness 5 mm outside center – Center hardness (Cc + 5) – (Cc) | 3 | 3 | 3 | 3 | 3 | 3 | 3 |
| | {(Cs) – (Cs – 5)} – {Cc + 5} – (Cc)} | 8 | 8 | 8 | 8 | 8 | 8 | 8 |
| | Surface hardness (Shore D) | 57 | 56 | 57 | 56 | 57 | 56 | 56 |
| | Initial velocity (m/s) | 77.8 | 77.8 | 77.8 | 77.8 | 77.8 | 77.8 | 77.8 |
| Intermediate layer | Material | No. 1 | No. 1 | No. 2 | No. 2 | No. 6 | No. 6 | No. 6 |
| | Thickness (mm) | 1.4 | 1.4 | 1.4 | 1.4 | 1.4 | 1.4 | 1.4 |
| | Intermediate layer thickness/Core diameter | 0.037 | 0.037 | 0.037 | 0.037 | 0.037 | 0.037 | 0.037 |
| | Specific gravity | 0.95 | 0.95 | 0.95 | 0.95 | 0.95 | 0.95 | 0.95 |
| | Material hardness (Shore D) | 63 | 63 | 63 | 63 | 68 | 68 | 68 |
| Intermediate layer-encased sphere | Diameter (mm) | 41.1 | 41.1 | 41.1 | 41.1 | 41.1 | 41.1 | 41.1 |
| | Weight (g) | 40.65 | 40.65 | 40.65 | 40.65 | 40.65 | 40.65 | 40.65 |
| | Surface hardness (Shore D) | 69 | 69 | 69 | 69 | 74 | 74 | 74 |
| | Initial velocity (m/s) | 78.1 | 78.1 | 78.2 | 78.2 | 78.4 | 78.4 | 78.4 |
| | Initial velocity of intermediate layer-encased sphere – Initial velocity of core (m/s) | 0.3 | 0.3 | 0.4 | 0.4 | 0.6 | 0.6 | 0.6 |
| | Surface hardness of intermediate layer-encased sphere – Surface hardness of core (Shore D) | 12 | 13 | 12 | 13 | 17 | 18 | 18 |
| Cover | Material | No. 4 | No. 4 | No. 4 | No. 4 | No. 4 | No. 4 | No. 4 |
| | Thickness (mm) | 0.8 | 0.8 | 0.8 | 0.8 | 0.8 | 0.8 | 0.8 |
| | Cover thickness/Core diameter | 0.021 | 0.021 | 0.021 | 0.021 | 0.021 | 0.021 | 0.021 |
| | Specific gravity | 1.15 | 1.15 | 1.15 | 1.15 | 1.15 | 1.15 | 1.15 |
| | Material hardness (Shore D) | 43 | 43 | 43 | 43 | 43 | 43 | 43 |
| | Dimples (Family A or Family B) | A | A | A | A | A | A | B |
| Coating layer | Material hardness (Shore D) | 63 | 63 | 63 | 63 | 63 | 63 | 63 |
| | (Cs – 5) – Hc | 11 | 10 | 11 | 10 | 11 | 10 | 10 |
| Ball | Diameter (mm) | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 |
| | Surface hardness (Shore D) | 57 | 57 | 57 | 57 | 60 | 60 | 60 |
| | Initial velocity (m/s) | 77.3 | 77.3 | 77.4 | 77.4 | 77.5 | 77.5 | 77.5 |
| | Surface hardness of core – Surface hardness of ball (Shore D) | 0 | −1 | 0 | −1 | −3 | −4 | −4 |
| | Surface hardness of ball – Surface hardness of intermediate layer (Shore D) | −12 | −12 | −12 | −12 | −14 | −14 | −14 |
| | Intermediate layer thickness – Cover thickness (mm) | 0.6 | 0.6 | 0.6 | 0.6 | 0.6 | 0.6 | 0.6 |

| | | | Comparative Example | | | | | |
|---|---|---|---|---|---|---|---|---|
| | | | 1 | 2 | 3 | 4 | 5 | 6 |
| | | Construction | 3-piece | 3-piece | 3-piece | 3-piece | 3-piece | 3-piece |
| Core | | Diameter (mm) | 39.3 | 37.7 | 37.5 | 38.9 | 38.3 | 38.3 |
| | | Weight (g) | 36.08 | 32.36 | 31.60 | 35.37 | 33.72 | 33.72 |
| | | Specific gravity | 1.135 | 1.153 | 1.145 | 1.147 | 1.146 | 1.146 |
| | | Deflection (mm) | 4.5 | 4.2 | 4.2 | 4.2 | 4.2 | 4.2 |
| | Hardness profile (JIS-C) | Surface hardness (Cs) | 84 | 85 | 85 | 85 | 85 | 85 |
| | | Hardness 5 mm inside surface (Cs – 5) | 73 | 74 | 74 | 74 | 74 | 74 |
| | | Hardness 5 mm outside center (Cc + 5) | 58 | 60 | 60 | 60 | 60 | 60 |
| | | Center hardness (Cc) | 55 | 57 | 57 | 57 | 57 | 57 |
| | | Surface hardness – Center hardness (Cs – Cc) | 29 | 28 | 28 | 28 | 28 | 28 |
| | | Surface hardness – Hardness 5 mm inside surface (Cs) – (Cs – 5) | 11 | 11 | 11 | 11 | 11 | 11 |
| | | Hardness 5 mm outside center – Center hardness (Cc + 5) – (Cc) | 3 | 3 | 3 | 3 | 3 | 3 |
| | | {(Cs) – (Cs – 5)} – {Cc + 5} – (Cc)} | 8 | 8 | 8 | 8 | 8 | 8 |
| | | Surface hardness (Shore D) | 56 | 57 | 57 | 57 | 57 | 57 |
| | | Initial velocity (m/s) | 77.8 | 77.8 | 77.8 | 77.8 | 77.8 | 77.8 |
| Intermediate layer | | Material | No. 2 | No. 1 | No. 1 | No. 1 | No. 3 | No. 1 |
| | | Thickness (mm) | 0.9 | 1.7 | 1.4 | 1.4 | 1.4 | 1.4 |
| | | Intermediate layer thickness/Core diameter | 0.023 | 0.045 | 0.037 | 0.036 | 0.037 | 0.037 |
| | | Specific gravity | 0.95 | 0.95 | 0.95 | 0.95 | 0.95 | 0.95 |
| | | Material hardness (Shore D) | 66 | 63 | 63 | 63 | 60 | 63 |
| Intermediate layer-encased sphere | | Diameter (mm) | 41.1 | 41.1 | 40.3 | 41.7 | 41.1 | 41.1 |
| | | Weight (g) | 40.65 | 40.65 | 38.26 | 42.51 | 40.65 | 40.65 |
| | | Surface hardness (Shore D) | 72 | 69 | 69 | 69 | 66 | 69 |
| | | Initial velocity (m/s) | 78.2 | 78.1 | 78.1 | 78.1 | 77.5 | 78.1 |
| | | Initial velocity of intermediate layer-encased sphere – Initial velocity of core (m/s) | 0.4 | 0.3 | 0.3 | 0.3 | −0.3 | 0.3 |
| | | Surface hardness of intermediate layer-encased sphere – Surface hardness of core (Shore D) | 16 | 12 | 12 | 12 | 9 | 12 |
| Cover | | Material | No. 4 | No. 4 | No. 4 | No. 4 | No. 4 | No. 5 |
| | | Thickness (mm) | 0.8 | 0.8 | 1.2 | 0.5 | 0.8 | 0.8 |
| | | Cover thickness/Core diameter | 0.020 | 0.021 | 0.032 | 0.013 | 0.021 | 0.021 |
| | | Specific gravity | 1.15 | 1.15 | 1.15 | 1.15 | 1.15 | 1.15 |
| | | Material hardness (Shore D) | 43 | 43 | 43 | 43 | 43 | 57 |
| | | Dimples (Family A or Family B) | A | A | A | A | A | A |

TABLE 6-continued

| | | | | | | |
|---|---|---|---|---|---|---|
| Coating layer | Material hardness (Shore D) | 63 | 63 | 63 | 63 | 63 |
| | (Cs − 5) − Hc | 10 | 11 | 11 | 11 | 11 |
| Ball | Diameter (mm) | 42.7 | 42.7 | 42.7 | 42.7 | 42.7 |
| | Weight (g) | 45.5 | 45.5 | 45.5 | 45.5 | 45.5 |
| | Surface hardness (Shore D) | 57 | 57 | 57 | 57 | 63 |
| | Initial velocity (m/s) | 77.4 | 77.3 | 77.2 | 76.7 | 77.3 |
| | Surface hardness of core − Surface hardness of ball (Shore D) | −1 | 0 | 0 | 0 | −6 |
| | Surface hardness of ball − Surface hardness of intermediate layer (Shore D) | −15 | −12 | −12 | −9 | −6 |
| | Intermediate layer thickness − Cover thickness (mm) | 0.1 | 0.9 | 0.2 | 0.6 | 0.6 |

In addition, the flight performance (W#1), spin performance on approach shots, feel, and durability on repeated impact of the golf balls obtained in the respective Working Examples and Comparative Examples were evaluated according to the criteria indicated below. The results are shown in Table 7.

TABLE 7

| | | Working Example | | | | | | | Comparative Example | | | | | |
|---|---|---|---|---|---|---|---|---|---|---|---|---|---|---|
| | | 1 | 2 | 3 | 4 | 5 | 6 | 7 | 1 | 2 | 3 | 4 | 5 | 6 |
| Flight (W#1, HS 40 m/s) | Spin rate (rpm) | 2,973 | 2,918 | 2,939 | 2,888 | 2,905 | 2,858 | 2,869 | 2,860 | 2,995 | 3,066 | | 3,133 | 2,843 |
| | Total distance (m) | 203.5 | 203.9 | 204.6 | 205.1 | 205.2 | 206.3 | 204.1 | 204.0 | 203.2 | 200.9 | | 199.8 | 205.2 |
| | Rating | good | good | good | good | good | good | good | good | good | NG | | NG | good |
| Performance on approach shots | Spin rate (rpm) | 6,203 | 6,188 | 6,175 | 6,151 | 6,147 | 6,114 | 6,116 | 6,121 | 6,236 | 6,267 | | 6,299 | 5,738 |
| | Rating | good | good | good | good | good | good | good | good | good | good | | good | NG |
| Feel at impact | Rating | good | good | good | good | good | good | good | good | NG | good | | good | NG |
| Durability to repeated impact | Rating | good | good | good | good | good | good | good | NG | good | good | | good | good |

Flight Performance (W#1 Shots)

A driver (W#1) was mounted on a golf swing robot, and the distance traveled by the ball when struck at a head speed (HS) of 40 m/s was measured and rated according to the criteria shown below. The club was a PHYZ driver (2016 model; loft angle, 10.5°) manufactured by Bridgestone Sports Co., Ltd. In addition, using an apparatus for measuring the initial conditions, the amount of spin was measured immediately after the ball was similarly struck.

Rating Criteria:

Good: Total distance was 202.0 m or more

NG: Total distance was less than 202.0 m

Spin Performance on Approach Shots

A sand wedge was mounted on a golf swing robot, and the amount of spin by the ball when struck at a head speed (HS) of 20 m/s was rated according to the following criteria.

Rating Criteria:

Good: Spin rate was 5,800 rpm or more

NG: Spin rate was less than 5,800 rpm

Feel

Sensory evaluations were carried out when the balls were hit with a driver (W#1) by amateur golfers having head speeds of between 35 and 45 m/s. The feel of the ball was rated according to the following criteria.

Rating Criteria:

Good: Six or more out of ten golfers rated the feel as good

NG: Five or fewer out of ten golfers rated the feel as good

Here, a "good feel" refers to a feel at impact that is appropriately soft.

Durability to Repeated Impact

A W#1 club was mounted on a golf swing robot and the balls in the respective Examples were repeatedly struck at a head speed of 40 m/s. The durability index in each Example was calculated relative to an arbitrary index of 100 for the number of shots at which the ball in Working Example 4 began to crack, and the durability was rated according to the following criteria.

Good: Durability index was 95 or more

NG: Durability index was less than 95

As demonstrated by the results in Table 7, the golf balls of Working Examples 1 to 7 were excellent in terms of flight performance, spin performance on approach shots, feel at impact and durability on repeated impact. The following results were obtained for the golf balls in Comparative Examples 1 to 6.

The golf ball in Comparative Example 1 had an (intermediate layer thickness)/(core diameter) value of less than 0.025. As a result, the durability to cracking on repeated impact was poor.

The golf ball in Comparative Example 2 had a core diameter smaller than 38.0 mm and an (intermediate layer thickness)/(core diameter) value greater than 0.043. As a result, the ball had a hard feel on full shots with an iron and in the short game.

The golf ball in Comparative Example 3 had a (cover thickness)/(core diameter) value of more than 0.027. As a result, the ball had a high spin rate on shots with a W#1 and thus a poor distance.

In Comparative Example 4, injection molding of the cover material to a target cover thickness of 0.5 mm (for a (cover thickness)/(core diameter) value of less than 0.014) was attempted during ball production, but the resin did not flow well throughout the interior of the injection mold cavity. As a result, ball molding was impossible.

In the golf ball of Comparative Example 5, the intermediate layer-encased sphere had a surface hardness on the Shore D hardness scale of less than 69 and the (intermediate layer-encased sphere initial velocity−core initial velocity) value was less than 0. As a result, the ball had a low initial velocity and the spin rate of the ball on shots with a W#1 was somewhat high, giving the ball a poor distance.

In the golf ball of Comparative Example 6, the cover had a Shore D hardness in excess of 55. As a result, the spin performance on approach shots was inferior.

Japanese Patent Application No. 2017-085059 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an intermediate layer encasing the core and a cover which encases the intermediate layer and has numerous dimples formed on an outside surface thereof (ball surface), wherein the intermediate layer is formed of a resin material, the cover is formed of a urethane resin material, the core has a diameter of at least 38.0 mm, a sphere obtained by encasing the core with the intermediate layer (intermediate layer-encased sphere) has a surface hardness on the Shore D hardness scale of at least 69, the cover has a material hardness on the Shore D hardness scale of 55 or less, the (intermediate layer thickness)/(core diameter) value is from 0.025 to 0.043, the (cover thickness)/(core diameter) value is from 0.014 to 0.027, and the intermediate layer-encased sphere has an initial velocity A and the core has an initial velocity B which together satisfy the condition A−B≥0 m/s, and wherein the core has a hardness profile from a center to a surface thereof which satisfies the following condition:

(JIS-C hardness at core surface−JIS-C hardness 5 mm inside of core surface)−(JIS-C hardness 5 mm outside of core center−JIS-C hardness at core center)≥0, wherein the surface of the cover has a coating layer formed thereon and the relationship between the material hardness Hc of the coating layer and the hardness 5 mm inside of the core surface (Cs−5) satisfies the following condition:

$$[(Cs-5)-Hc]\geq 0.$$

2. The multi-piece solid golf ball of claim 1, wherein the core has a center and a surface such that the value obtained by subtracting the JIS-C hardness at the core center from the JIS-C hardness at the core surface is at least 15.

3. The multi-piece solid golf ball of claim 1, wherein the (intermediate layer thickness)/(core diameter) value is from 0.028 to 0.041 and the (cover thickness)/(core diameter) value is from 0.017 to 0.024.

4. The multi-piece solid golf ball of claim 1, wherein the value obtained by subtracting the Shore D hardness at a surface of the core from the Shore D hardness at a surface of the intermediate layer-encased sphere is at least 6, the value obtained by subtracting the Shore D hardness at the surface of the intermediate layer-encased sphere from the Shore D hardness at the ball surface is 0 or less, and the value obtained by subtracting the Shore D hardness at the ball surface from the Shore D hardness at the core surface is −5 or more.

5. The multi-piece solid golf ball of claim 1, wherein the initial velocities of the core, the intermediate layer-encased sphere and the ball satisfy the following relationship:

initial velocity of intermediate layer-encased sphere≥initial velocity of core>initial velocity of ball.

6. The multi-piece solid golf ball of claim 1, wherein the dimples formed on the ball surface are of at least three types of differing diameter or depth or both, the total number of dimples is from 250 to 380 and the dimple surface coverage SR, defined as the proportion of the ball surface accounted for by the total surface area of the hypothetical spherical surfaces circumscribed by the edges of the individual dimples, is at least 70%.

7. The multi-piece solid golf ball of claim 1, wherein the ball has arranged thereon at least one dimple having the cross-sectional shape specified by steps (i) to (iv) below (dimple having a specific cross-sectional shape):

(i) letting the foot of a perpendicular drawn from a deepest point of the dimple to an imaginary plane defined by a peripheral edge of the dimple be the dimple center and a straight line that passes through the dimple center and any one dimple edge be the reference line;

(ii) dividing a segment of the reference line from the dimple edge to the dimple center into at least 100 points and computing the distance ratio for each point when the distance from the dimple edge to the dimple center is set to 100%;

(iii) computing the dimple depth ratio at every 20% from 0 to 100% of the distance from the dimple edge to the dimple center; and (iv) at the depth ratios in dimple regions 20 to 100% of the distance from the dimple edge to the dimple center, determining the change in depth ΔH every 20% of said distance and designing a dimple cross-sectional shape such that the change ΔH is at least 6% and not more than 24% in all regions corresponding to from 20 to 100% of said distance.

8. The multi-piece solid golf ball of claim 1, wherein the core has a deflection when compressed under a final load of 1,275 N (130 kgf) from an initial load of 98 N (10 kgf) of at least 3.9 mm.

9. The multi-piece solid golf ball of claim 1, wherein the condition of (JIS-C hardness at core surface−JIS-C hardness 5 mm inside of core surface)−(JIS-C hardness 5 mm outside of core center−JIS-C hardness at core center) in the hardness profile of the core is from 5 to 13.

10. The multi-piece solid golf ball of claim 1, wherein the core has a deflection when compressed under a final load of 1,275 N (130 kgf) from an initial load of 98 N (10 kgf) of from 4.2 to 5.0 mm.

11. A multi-piece solid golf ball comprising a core, an intermediate layer encasing the core and a cover which encases the intermediate layer and has numerous dimples formed on an outside surface thereof (ball surface), wherein the intermediate layer is formed of a resin material, the cover is formed of a urethane resin material, the core has a diameter of at least 38.0 mm, the sphere obtained by encasing the core with the intermediate layer (intermediate layer-encased sphere) has a surface hardness on the Shore D hardness scale of at least 69, the cover has a material hardness on the Shore D hardness scale of 55 or less, the (intermediate layer thickness)/(core diameter) value is from 0.025 to 0.043, the (cover thickness)/(core diameter) value is from 0.014 to 0.027, and the intermediate layer-encased sphere has an initial velocity A and the core has an initial velocity B which together satisfy the condition A−B≥0 m/s, and wherein the core has a deflection when compressed under a final load of 1,275 N (130 kgf) from an initial load of 98 N (10 kgf) of at least 3.9 mm.

12. The multi-piece solid golf ball of claim 11, wherein the core has a center and a surface such that the value obtained by subtracting the JIS-C hardness at the core center from the JIS-C hardness at the core surface is at least 15.

13. The multi-piece solid golf ball of claim 11, wherein the (intermediate layer thickness)/(core diameter) value is from 0.028 to 0.041 and the (cover thickness)/(core diameter) value is from 0.017 to 0.024.

14. The multi-piece solid golf ball of claim 11, wherein the value obtained by subtracting the Shore D hardness at a surface of the core from the Shore D hardness at a surface of the intermediate layer-encased sphere is at least 6, the value obtained by subtracting the Shore D hardness at the surface of the intermediate layer-encased sphere from the Shore D hardness at the ball surface is 0 or less, and the value obtained by subtracting the Shore D hardness at the ball surface from the Shore D hardness at the core surface is −5 or more.

15. The multi-piece solid golf ball of claim 11, wherein the initial velocities of the core, the intermediate layer-encased sphere and the ball satisfy the following relationship:

initial velocity of intermediate layer-encased sphere≥initial velocity of core>initial velocity of ball.

16. The multi-piece solid golf ball of claim 11, wherein the dimples formed on the ball surface are of at least three types of differing diameter or depth or both, the total number of dimples is from 250 to 380 and the dimple surface coverage SR, defined as the proportion of the ball surface accounted for by the total surface area of the hypothetical spherical surfaces circumscribed by the edges of the individual dimples, is at least 70%.

17. The multi-piece solid golf ball of claim 11, wherein the ball has arranged thereon at least one dimple having the cross-sectional shape specified by steps (i) to (iv) below (dimple having a specific cross-sectional shape):

(i) letting the foot of a perpendicular drawn from a deepest point of the dimple to an imaginary plane defined by a peripheral edge of the dimple be the dimple center and a straight line that passes through the dimple center and any one dimple edge be the reference line;

(ii) dividing a segment of the reference line from the dimple edge to the dimple center into at least 100 points and computing the distance ratio for each point when the distance from the dimple edge to the dimple center is set to 100%;

(iii) computing the dimple depth ratio at every 20% from 0 to 100% of the distance from the dimple edge to the dimple center; and (iv) at the depth ratios in dimple regions 20 to 100% of the distance from the dimple edge to the dimple center, determining the change in depth ΔH every 20% of said distance and designing a dimple cross-sectional shape such that the change ΔH is at least 6% and not more than 24% in all regions corresponding to from 20 to 100% of said distance.

18. The multi-piece solid golf ball of claim 11, wherein the surface of the cover has a coating layer formed thereon and the relationship between the material hardness Hc of the coating layer and the hardness 5 mm inside of the core surface (Cs−5) satisfies the following condition:

$$[(Cs-5)-Hc]\geq 0.$$

19. The multi-piece solid golf ball of claim 11, wherein the core has a hardness profile from a center to a surface thereof which satisfies the following condition:

5≤(JIS-C hardness at core surface−JIS-C hardness 5 mm inside of core surface)−(JIS-C hardness 5 mm outside of core center−JIS-C hardness at core center)≤13.

* * * * *